US011613880B1

(12) United States Patent
Zhou et al.

(10) Patent No.: US 11,613,880 B1
(45) Date of Patent: Mar. 28, 2023

(54) ADJUSTABLE HEIGHT SQUARE OUTER COVER WITH BUILT-IN CYLINDER

(71) Applicant: ZHONGSHAN MEITU PLASTIC IND. CO., LTD., Zhongshan (CN)

(72) Inventors: Wenhui Zhou, Zhongshan (CN); Hai Zhang, Zhongshan (CN); Haojia Huang, Zhongshan (CN); Qian Shen, Zhongshan (CN); Ke Xiao, Zhongshan (CN)

(73) Assignee: ZHONGSHAN MEITU PLASTIC IND. CO., LTD., Zhongshan (CN)

( * ) Notice: Subject to any disclaimer, the term of this patent is extended or adjusted under 35 U.S.C. 154(b) by 0 days.

(21) Appl. No.: 17/676,777

(22) Filed: Feb. 21, 2022

(30) Foreign Application Priority Data

Dec. 3, 2021 (CN) ..... 202111474975.4

(51) Int. Cl.
*E03D 1/012* (2006.01)

(52) U.S. Cl.
CPC ..... *E03D 1/0125* (2013.01)

(58) Field of Classification Search
CPC ..... E03D 1/0125
USPC ..... 4/353
See application file for complete search history.

(56) References Cited

FOREIGN PATENT DOCUMENTS

| | | | |
|---|---|---|---|
| CN | 203440881 | U | 2/2014 |
| DE | 102017002280 | A1 | 9/2018 |
| EP | 0754808 | A1 | 1/1997 |
| EP | 3282058 | A1 | 2/2018 |
| EP | 3305997 | A1 | 4/2018 |
| EP | 3530823 | A1 | 8/2019 |
| EP | 3587680 | A1 | 1/2020 |

*Primary Examiner* — Christine J Skubinna
(74) *Attorney, Agent, or Firm* — Bayramoglu Law Offices LLC

(57) ABSTRACT

An adjustable height square outer cover with a built-in cylinder includes a water tank shell and a square outer cover, the water tank shell is provided with an installation accommodation cavity for containing the square outer cover, the water tank shell is also provided with support rack teeth, a locking release device is arranged in the square outer cover, and the locking release device is provided with locking release rack teeth matched with the support rack teeth. A first mounting cavity is arranged in the square outer cover, a support which can be adjusted horizontally is movably arranged in the first mounting cavity, a cylinder which can be adjusted longitudinally is movably arranged on the support, a pressing button is arranged on the cylinder, and the square outer cover is also clamped with a decorative cover for covering the first mounting cavity.

15 Claims, 31 Drawing Sheets

B

E

F

G

H

ADJUSTABLE HEIGHT SQUARE OUTER COVER WITH BUILT-IN CYLINDER

CROSS REFERENCE TO THE RELATED APPLICATIONS

This application is based upon and claims priority to Chinese Patent Application No. 202111474975.4, filed on Dec. 3, 2021, the entire contents of which are incorporated herein by reference.

TECHNICAL FIELD

The disclosure relates to the technical field of toilet, in particular to an adjustable height square outer cover with a built-in cylinder.

BACKGROUND

With the progress of the times, people hide the water tank in the wall and only expose the flush button for the overall beauty of the toilet after assembly.

Therefore, the utility model patent with Publication No. CN203440881U discloses a flushing panel structure of a concealed water tank and a concealed water tank. The flushing panel structure of the concealed water tank includes a protection frame of the water tank maintenance port and a flushing panel. The flushing panel is installed in the protection frame of the water tank maintenance port. In the flushing panel structure of the concealed water tank of the utility model, the flushing panel structure of the concealed water tank includes a protection frame of the water tank maintenance port and a flushing panel, and the flushing panel is installed in the protection frame of the water tank maintenance port. The protection frame of the water tank maintenance port is fixed in the water tank maintenance port, which can reliably protect the flushing panel from damage. The flushing panel structure of the concealed water tank and the concealed water tank of the utility model are especially matched with squat toilet, toilet bowl, hanging toilet and other fields.

The above patent has the following problems: after the flushing panel structure is assembled, if the protection frame body is higher than the wall, the flushing panel can not fit with the wall, so it can only be cut along the cutting groove to cut the protection frame body flush with the wall, which is inconvenient for installation and commissioning and can not adapt to different installation environments. During installation and cutting, it is easy to damage the protection frame body or wall, the cut frame has no reuse value and increases the cost. During manufacturing, the protective frame body needs to be reserved enough height to increase the production cost. The applicability of the product is poor, and the installation position of the cylinder for flushing cannot be adjusted.

Therefore, the existing technology can not meet the current demand.

SUMMARY

In order to solve the above problems, the disclosure provides a square outer cover with a built-in cylinder and adjustable height for easy adjustment.

In order to achieve the above objective, the disclosure provides the following technical solution An adjustable height square outer cover with a built-in cylinder, including a water tank shell and a square outer cover movably arranged on the water tank shell, and the water tank shell is provided with an installation accommodation cavity containing the square outer cover, wherein the water tank shell is also provided with a support rack teeth, the square outer cover is provided with a locking release device, the locking release device includes a handle, a pull rod hinged with the handle, a first locking block and a second locking block linked with the pull rod, and at least two first connecting rods and at least two second connecting rods; the first locking block and the second locking block are respectively provided with locking release rack teeth matched with the support rack teeth; the pull rod is hinged with the first locking block through two parallel first connecting rods, so that a parallelogram structure is formed between the pull rod, the first locking block and the two first connecting rods after assembly; the pull rod is hinged with the second locking block through two parallel second connecting rods, so that a parallelogram structure is formed between the pull rod, the second locking block and the two second connecting rods after assembly; a first mounting cavity is provided inside the square outer cover, the first mounting cavity is movably provided with a support which is able to adjust laterally relative to the first mounting cavity, the support is movably provided with a cylinder which is able to adjust longitudinally relative to the support, and the locking release device is adjusted so that the locking release rack teeth and the support rack teeth are out of engagement, thus, a distance of the square outer cover extending out of the installation accommodation cavity is adjusted.

As a preferred embodiment, it is further limited to: one end of the first connecting rod is hinged with the pull rod, the other end of the first connecting rod is hinged with the first locking block, and one end of the second connecting rod is hinged with the pull rod, the other end of the second connecting rod is hinged with the second locking block, and one end of the first connecting rod is hinged with one end of the second connecting rod; when the pull rod is pulled to translate towards both sides by the handle, the first connecting rod and the second connecting rod swing and drive the first locking block and the second locking block to expand towards both ends or retract inward, so that the locking release rack teeth extend out of the square outer cover or retract into the square outer cover.

As a preferred embodiment, it is further limited to: the water tank shell comprises a shell body and a fixed support fixedly arranged on the shell body, the installation accommodation cavity is arranged in the shell body, and the shell body is provided with a shell opening; the fixed support is provided with a support through hole aligned with the shell opening after assembly, and the support rack teeth is symmetrically arranged on an inner wall of the support through hole; during locking, the locking release rack teeth reach out from the square outer cover and engage with the support rack teeth; when the lock is disengaged, the locking release rack teeth is retracted into the square outer cover, so that the locking release rack teeth and the support rack teeth is disengaged, so as to adjust the distance of the square outer cover extending out of the installation accommodation cavity.

As a preferred embodiment, it is further limited to: the square outer cover is provided with a second mounting cavity for an installation of the handle and a third mounting cavity for an installation of the locking release device, a connecting through hole for the pull rod to pass through after assembly is arranged between the third mounting cavity and the second mounting cavity, an inner wall of the third mounting cavity is provided with a transverse chute and a longitudinal chute, and the pull rod is provided with a pull rod sliding strip sliding in the transverse chute after assembly; and both the first locking block and the second locking block are provided with a locking block sliding strip sliding in the longitudinal chute after assembly.

As a preferred embodiment, it is further limited to: the handle comprises a handle main body part and a handle portion integrated with the handle main body part, the pull rod is provided with a second pull rod hole, the handle main body part is provided with a handle mounting cavity, and an inner wall of the handle mounting cavity is provided with a raised handle hinge shaft matched with the second pull rod hole.

As a preferred embodiment, it is further limited to: an inner wall of the second mounting cavity is respectively provided with a raised positioning column, a positioning strip and a positioning flange, and the handle main body part is provided with a positioning groove matched with the positioning flange; when the locking release device is in a locked state, an end face of one end of the handle portion towards the handle body part butts against the positioning strip, and the positioning groove is clamped in the positioning flange; when the locking release device is in the unlocked state, an end face of one end of the handle body part towards the handle portion butts against the positioning column.

As a preferred embodiment, it is further limited to: the handle is also provided with an unlocking contact surface and a locking contact surface, and the unlocking contact surface is against the inner wall of the second mounting cavity when the locking release device is in the unlocked state; the locking contact surface is against the inner wall of the second mounting cavity when the locking release device is in the locked state; a distance D1 between an axis of the handle hinge shaft and the unlocking contact surface is less than a distance D2 between the axis of the handle hinge shaft and the locking contact surface, so that when the handle locks the locking release device, the pull rod is partially pulled into the second mounting cavity by the handle, so that the first connecting rod and the second connecting rod swing and drive the first locking block and the second locking block to expand towards both ends.

As a preferred embodiment, it is further limited to: the first mounting cavity is provided with a first clamping teeth, and the support comprises a support body and a support adjusting plate whose one end is connected with the support body, a second clamping teeth matched with the first clamping teeth is arranged on an outer end face of the support adjusting plate, and a position avoidance groove is also arranged between the support adjusting plate and the support body; when the support adjusting piece is moved, the second clamping teeth is out of engagement from the first clamping teeth, and the support is moved laterally to adjust the relative position of the support in the first mounting cavity.

As a preferred embodiment, it is further limited to: a raised first clamping part is arranged on the inner wall of the first mounting cavity, and a top of the first clamping part extends to one side to form a second clamping part, a first clamping groove is formed between one end of the second clamping part and the inner wall of the first mounting cavity, and the other end of the second clamping part is provided with the first clamping teeth; the support body is located on the end face of one end of the support adjusting plate, and is also provided with a raised first connecting part; a top of the first connecting part extends to one side to form a second connecting part inserted into the first clamping groove after assembly, a first connecting groove for inserting the second clamping part after assembly is formed between the second connecting part and the support body; the support adjusting plate is provided with a first bump on a side of the second clamping teeth, and a first holding groove containing the second clamping part is formed between the first bump and the first connecting part.

As a preferred embodiment, it is further limited to: one end of the support body away from the first connecting part is provided with an extension part extending outward, and the inner wall of the first mounting cavity is provided with a raised first cushion block for supporting the extension part.

As a preferred embodiment, it is further limited to: the support body is provided with an adjusting cavity, an inner wall of the adjusting cavity is provided with a third clamping teeth, and the cylinder comprises a cylinder body and a connecting cover arranged on the cylinder body; the connecting cover comprises a connecting cover body and a cylinder adjusting plate with one end connected with the connecting cover body, and an outer end face of the cylinder adjusting plate is provided with a fourth clamping teeth matched with the third clamping teeth; when the support adjusting plate is moved, the fourth clamping teeth is out of engagement from the third clamping teeth, and the cylinder is moved longitudinally to adjust the relative position of the cylinder in the support.

As a preferred embodiment, it is further limited to: the cylinder adjusting plate comprises an adjusting plate connecting part fixedly connected with the connecting cover body and an elastic part integrally formed with the adjusting plate connecting part, an avoidance space is formed between the elastic part and the connecting cover body, and an end face on one side of the elastic part away from the connecting cover body extends outward to form a handle portion.

As a preferred embodiment, it is further limited to: the connecting cover body is provided with positioning strips located on both sides of the cylinder adjusting plate, and the support body is provided with a chute matched with the positioning strips.

As a preferred embodiment, it is further limited to: the cylinder is provided with a pressing button, and the square outer cover is clamped with a decorative cover for covering the first mounting cavity; and the decorative cover is provided with a button opening for exposing the pressing button.

As a preferred embodiment, it is further limited to: the decorative cover is provided with a decorative cover buckle, and the square outer cover outer is provided with a clamping groove matched with the decorative cover buckle.

The advantageous effects of the disclosure are as following:

1. When the disclosure requires adjustment, when the pull rod is pulled by the handle to translate towards both sides, the first connecting rod and the second connecting rod swing and drive the first locking block and the second locking block to retract inward, so that the locking release rack teeth retract into the square outer cover, so as to separate the locking release rack teeth from the support rack teeth. Thus, after the square outer cover is adjusted to the flush position with the wall, the handle is moved to drive the first locking block and the second locking block to expand towards both ends through the pull rod, the first connecting rod and the second connecting rod, so that the locking release rack teeth extend from the square outer cover and engage with the support rack teeth to complete the locking, which is convenient for adjustment without the requirement of cutting, reducing the use of tools, so that the manufacturing and installation costs are greatly reduced. The applicability of the product is good, and the square outer cover can be taken out as a whole during the maintenance of the water tank, which is convenient for maintenance.

2. The first mounting cavity of the square outer cover of the disclosure is provided with the first clamping teeth, and the support is provided with the second clamping teeth matched with the first clamping teeth. When the support adjusting plate is moved, the second clamping teeth are out of engagement from the first clamping teeth, and the support is moved laterally to adjust the relative position of the support in the first mounting cavity. The support is also provided with the third clamping teeth, and the cylinder is provided with the fourth clamping teeth matched with the third clamping teeth. When the support adjusting plate is moved, the fourth clamping teeth are out of engagement from the third clamping teeth, and the cylinder is moved longitudinally to adjust the relative position of the cylinder in the support. When there is deviation in the installation of the flushing panel or the user changes the flushing panel, the position of the cylinder in the first mounting cavity can be adjusted, so that the pressing button of the cylinder for flushing is matched with the installation position of the flushing panel. The adjustment is simple and fast. The adjustment can be completed by hand without other tools, so that the pressing button can be matched with the installation position of the flushing panel. At the same time, it is also applicable to more flushing panels. Users can freely replace the flushing panel according to their own design and needs, and the user experience is good.

DETAILED DESCRIPTION OF THE EMBODIMENTS

Figure 1:
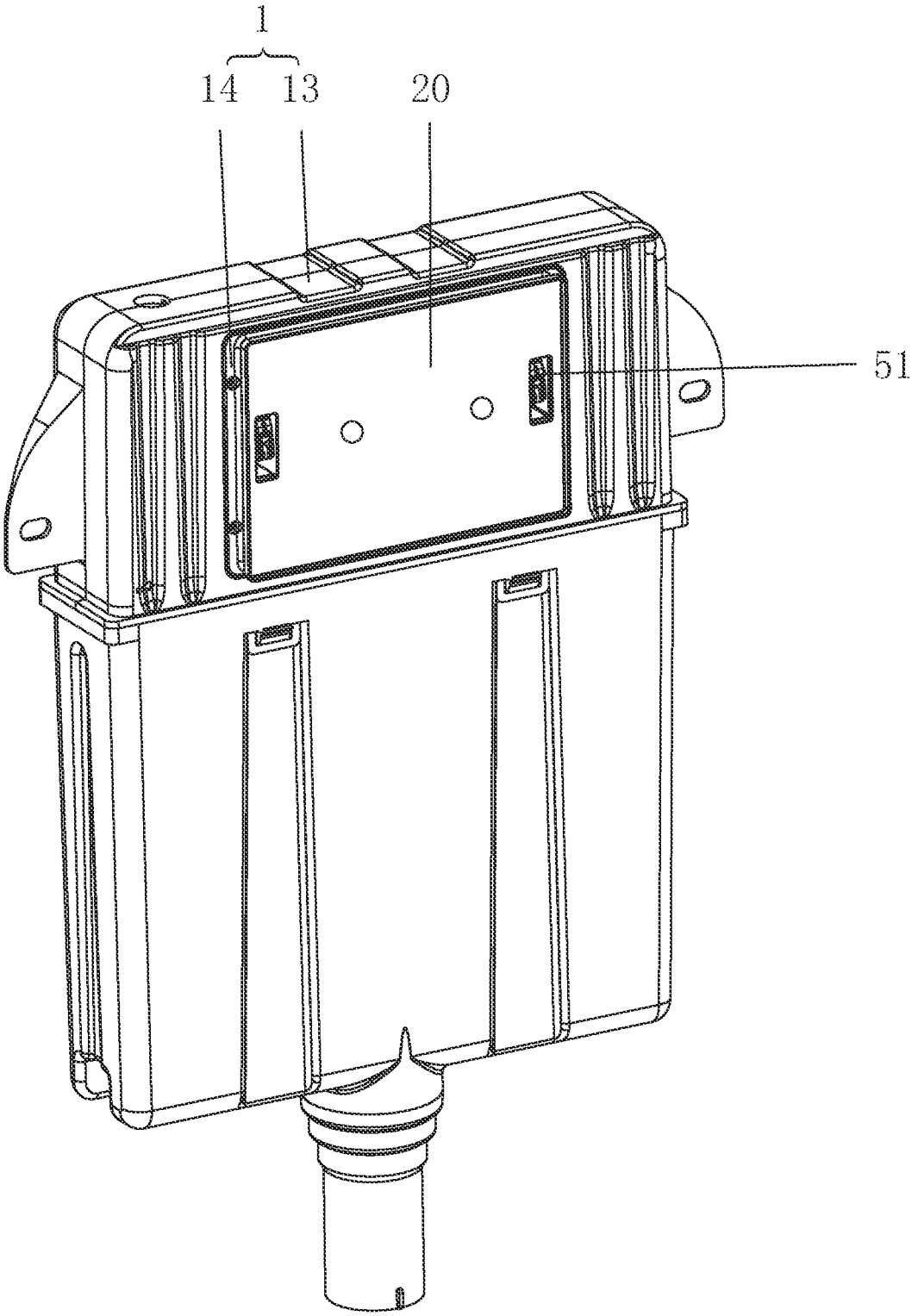
FIG. 1 is a structural diagram of the present disclosure.
Figure 2:
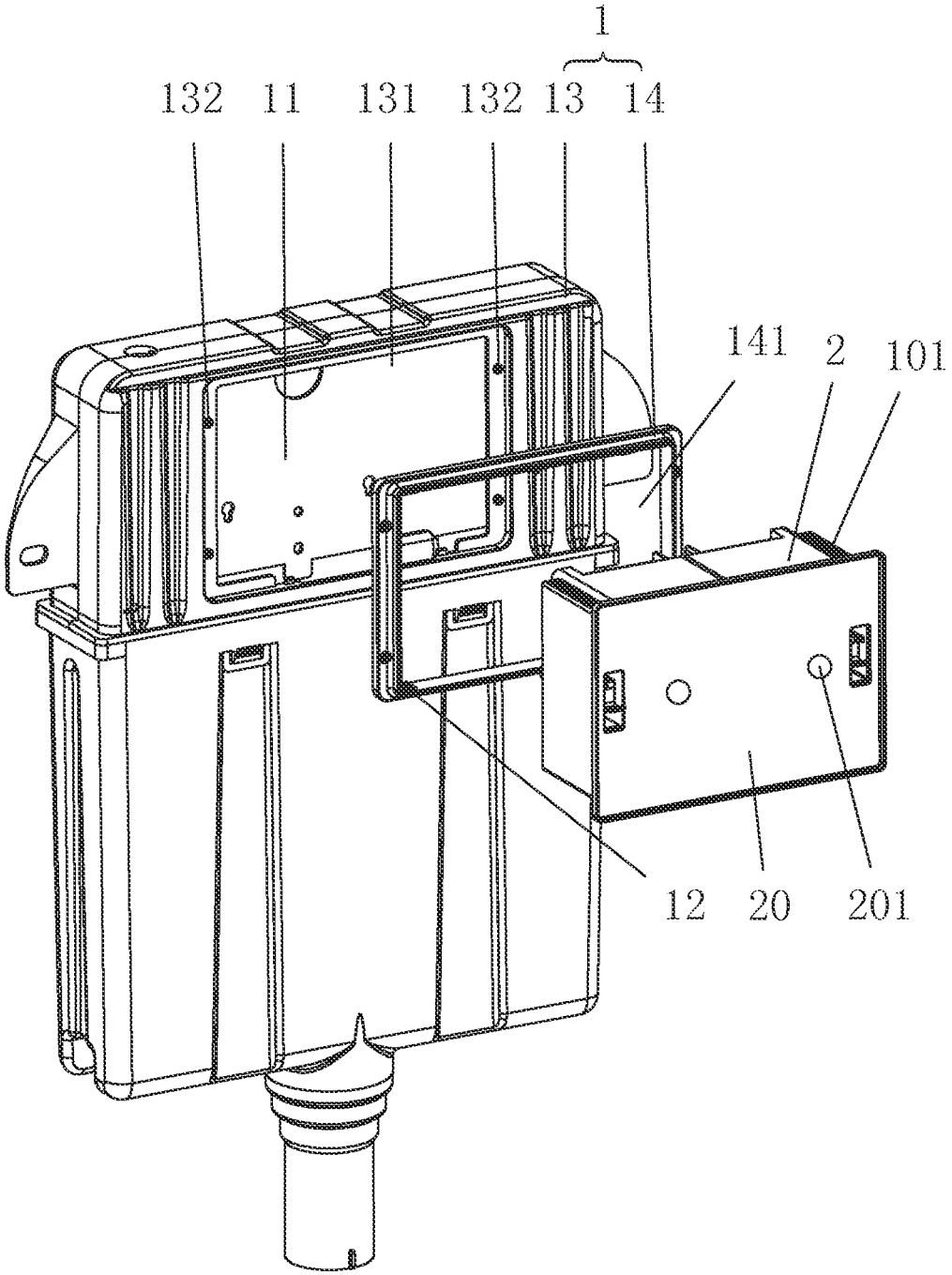
FIG. 2 is an exploded view of the present disclosure.
Figure 3:
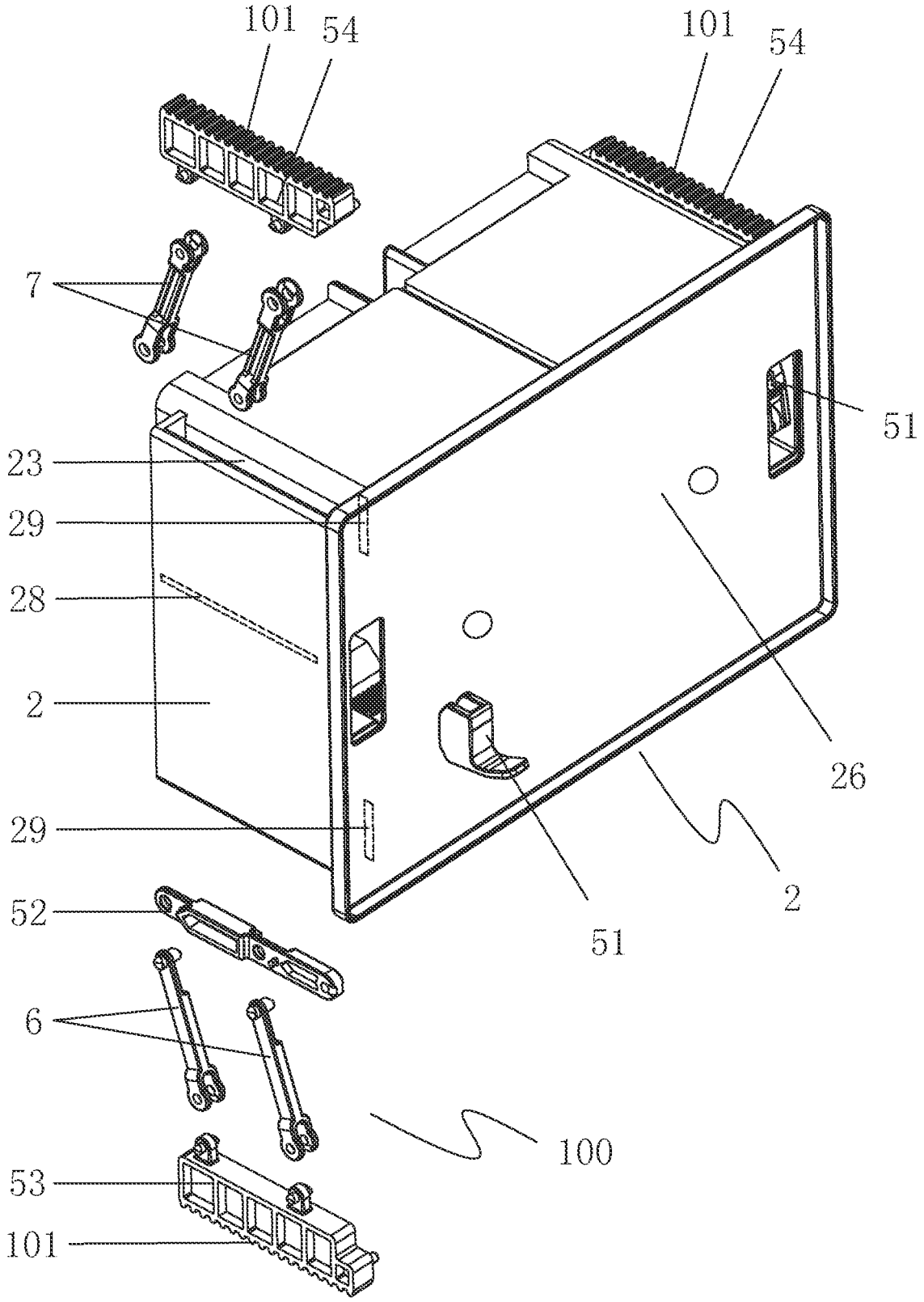
FIG. 3 is the first partial exploded views of the square outer cover.
Figure 4:
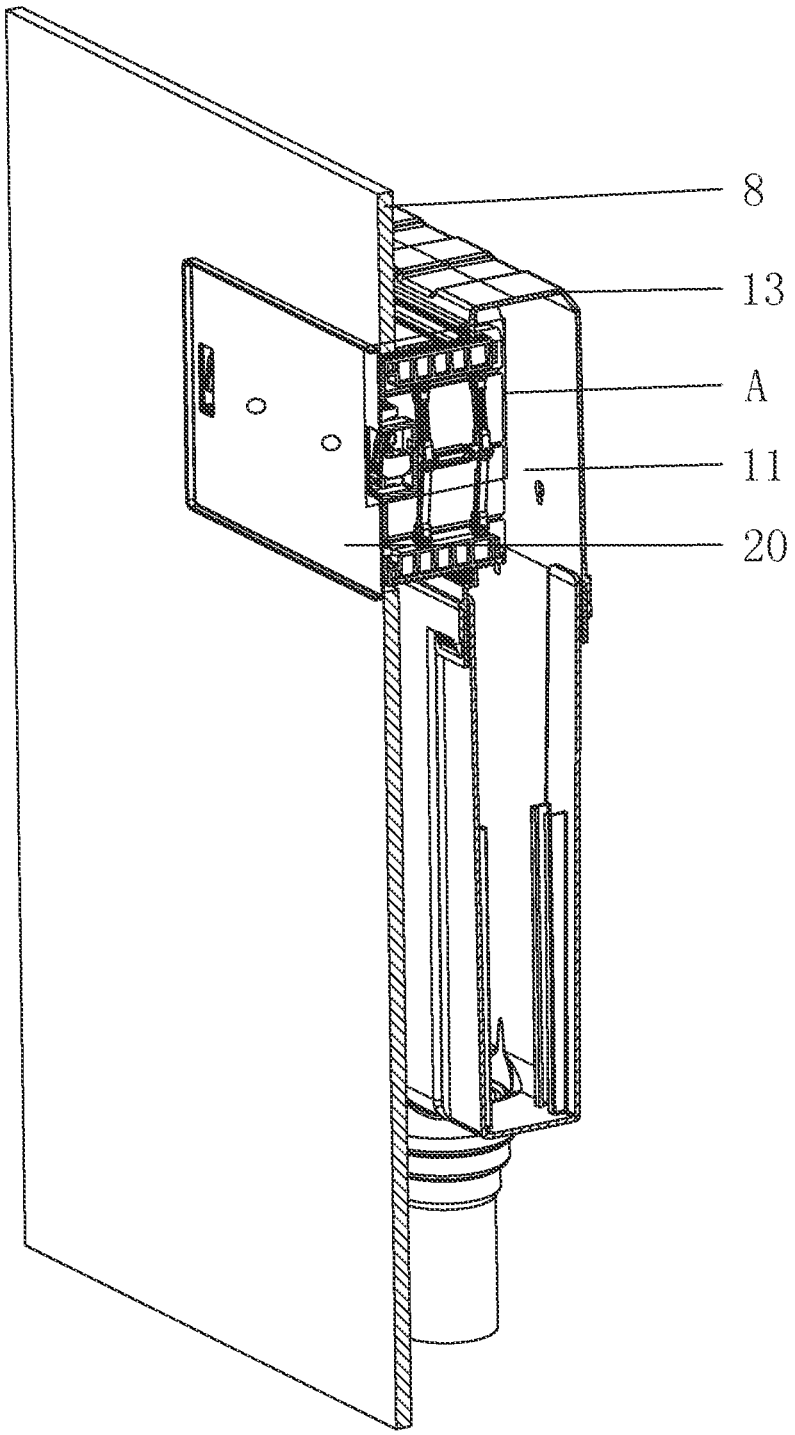
FIG. 4 is a cross-sectional view when the disclosure is assembled in the wall and in a locked state.
Figure 5:
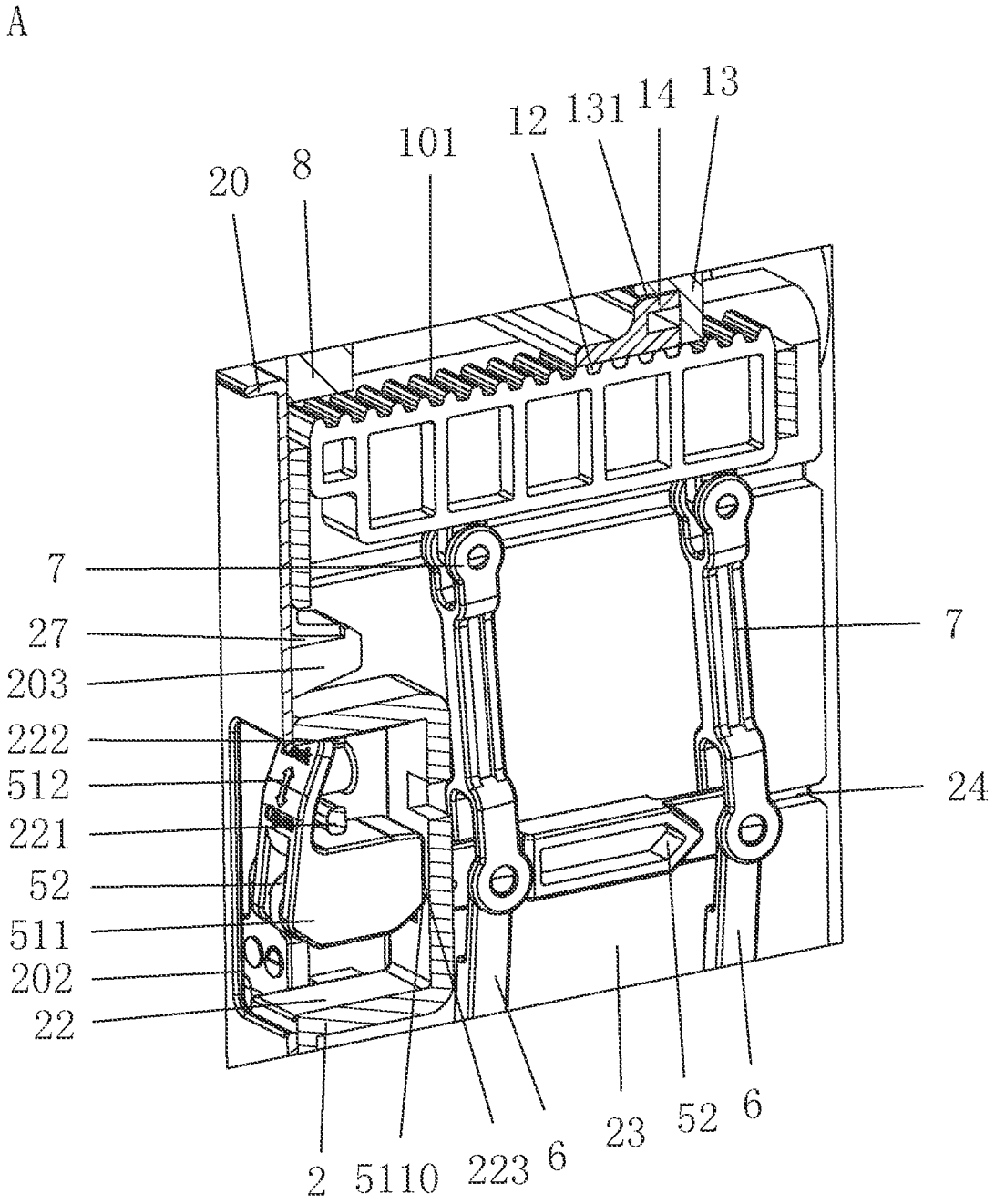
FIG. 5 is an enlarged schematic diagram of A in FIG. 4.
Figure 6:
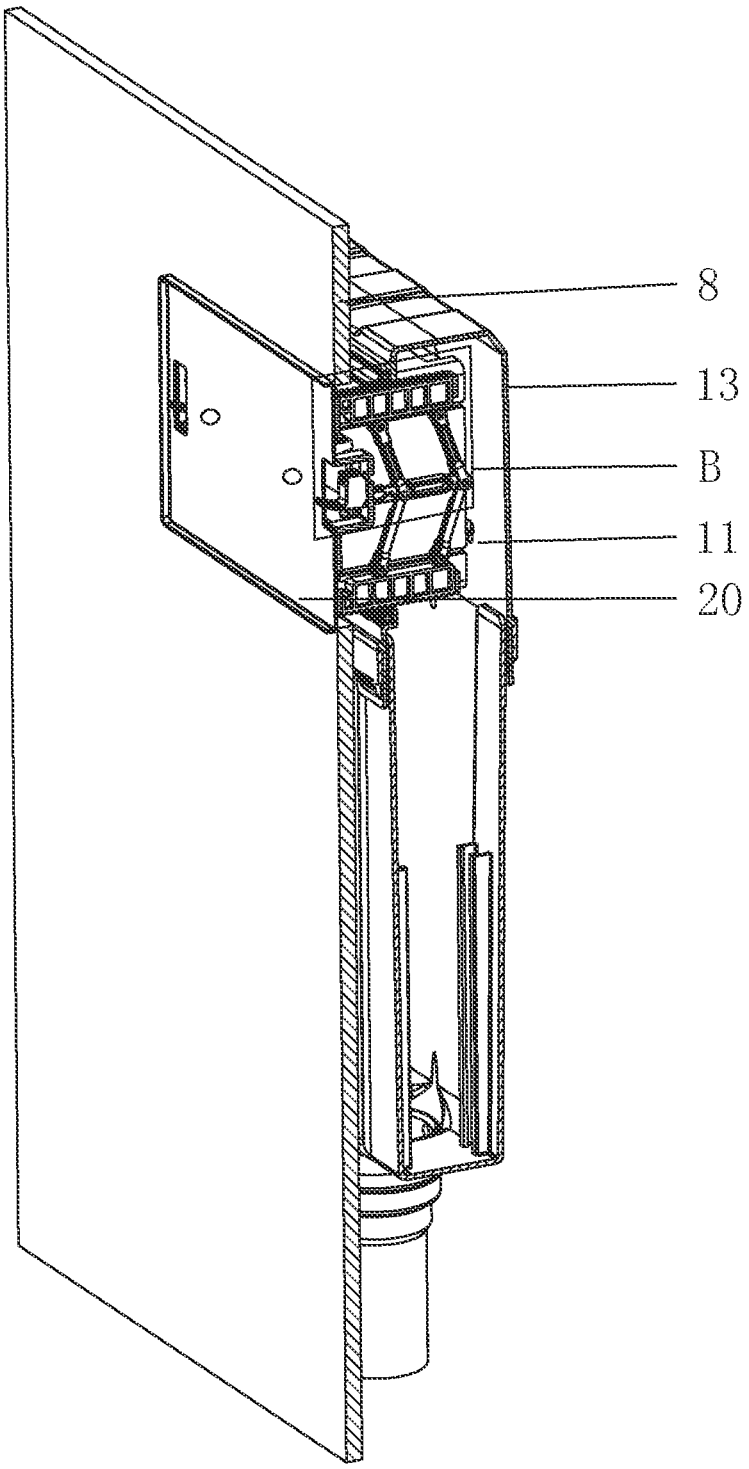
FIG. 6 is a cross-sectional view when the disclosure is assembled in the wall and in the unlocked state.
Figure 7:
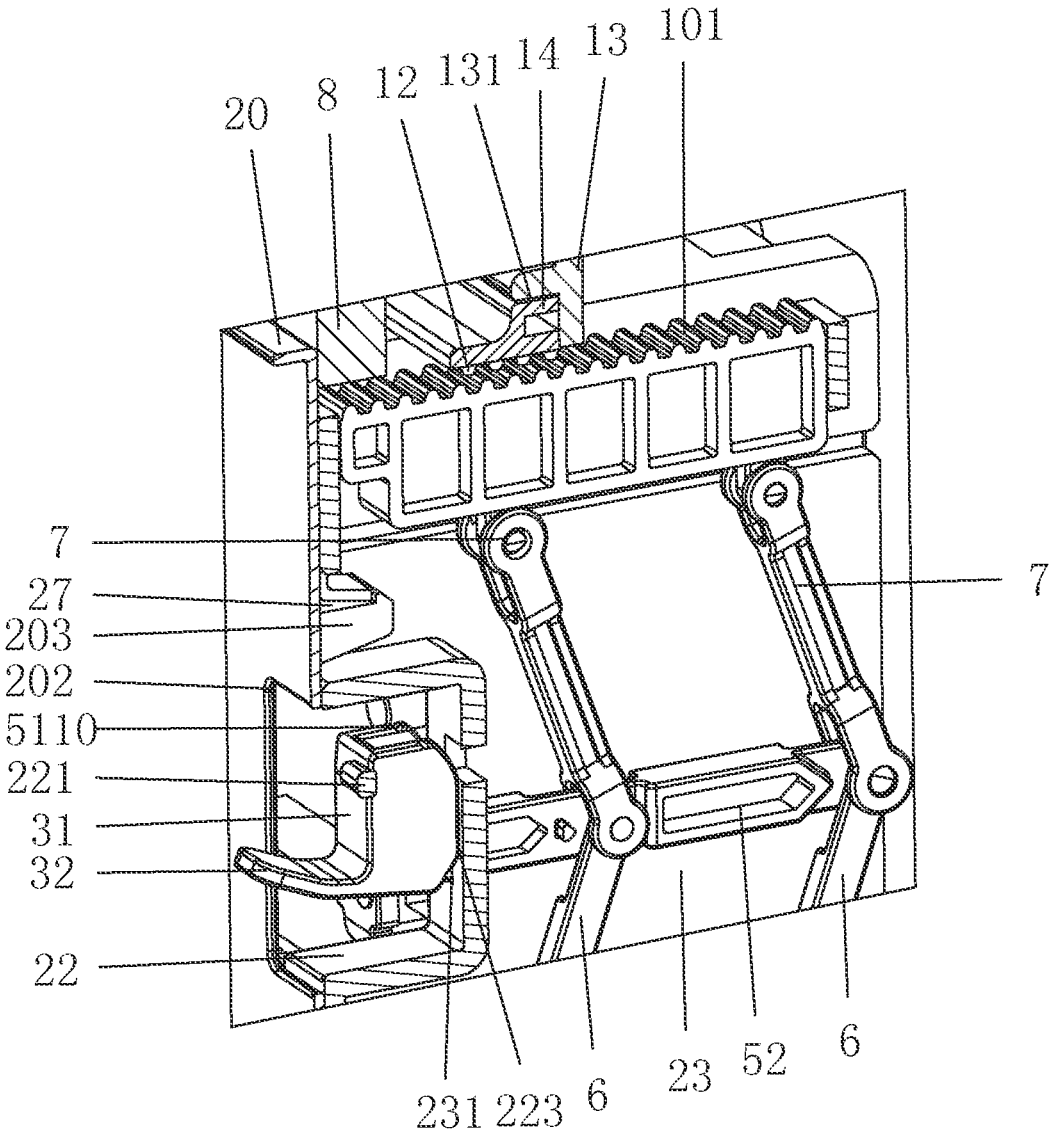
FIG. 7 is an enlarged schematic diagram of B in FIG. 6.
Figure 8:
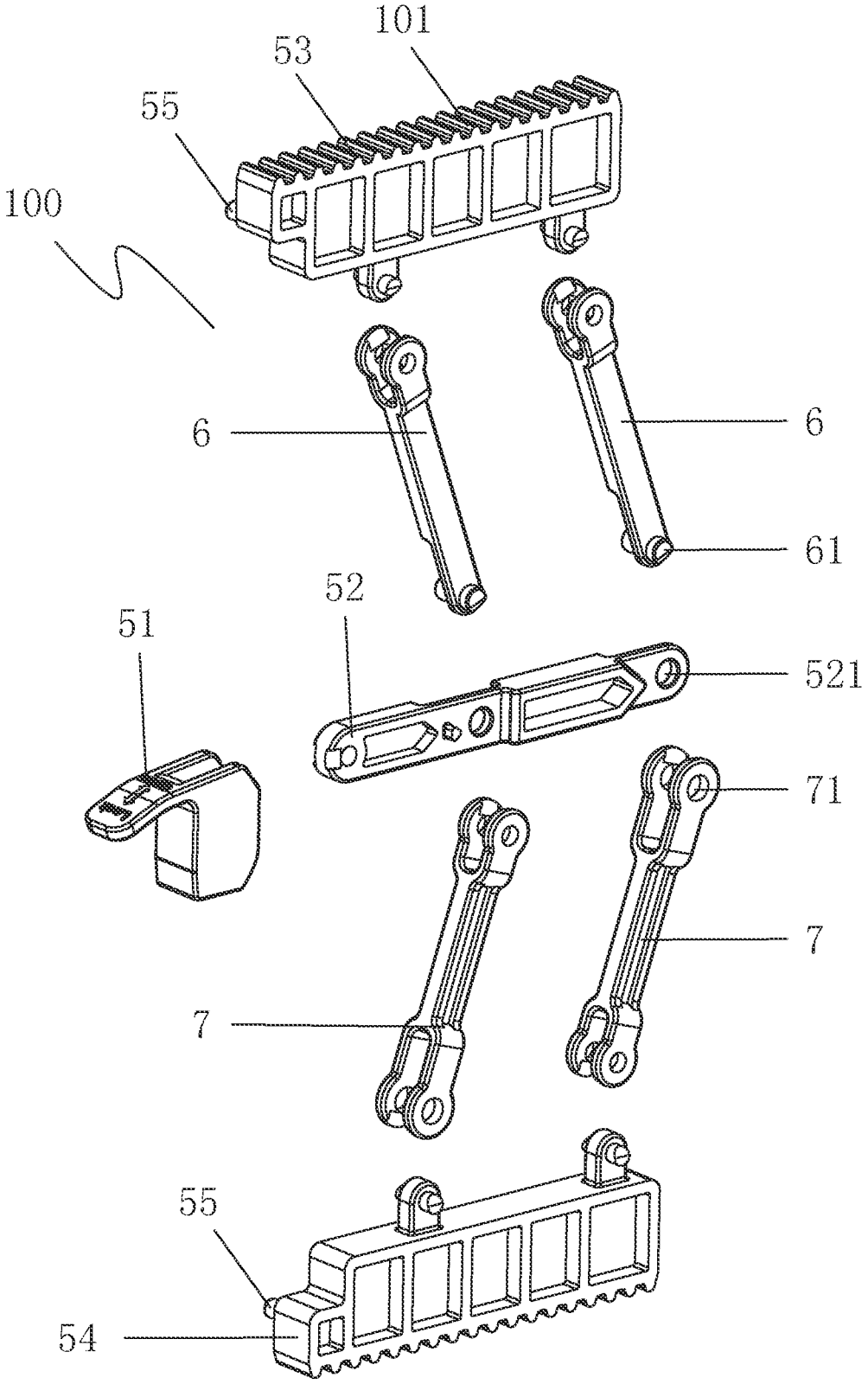
FIG. 8 is an exploded view of the locking release device.
Figure 9:
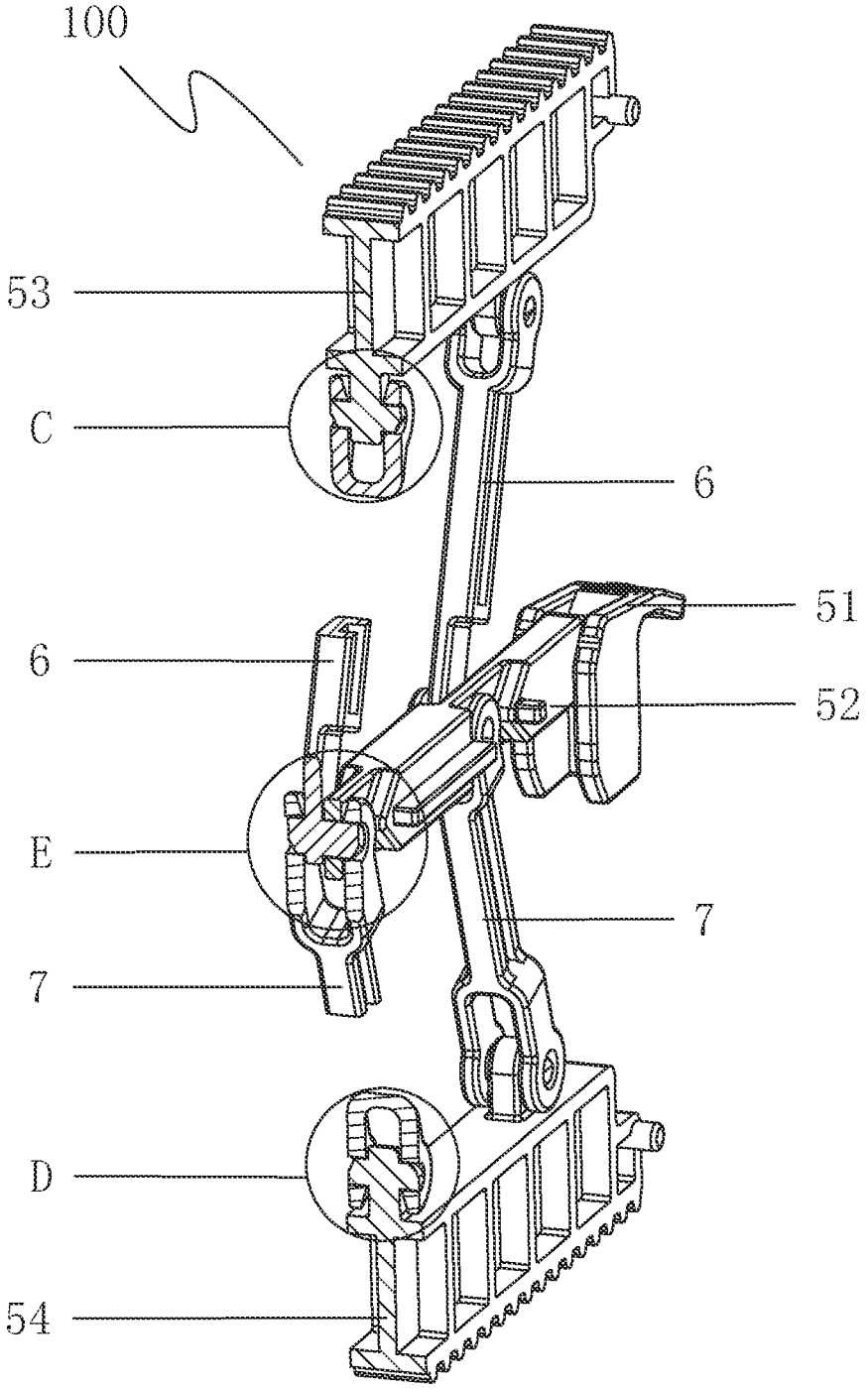
FIG. 9 is a sectional view of the locking release device.
Figure 10:
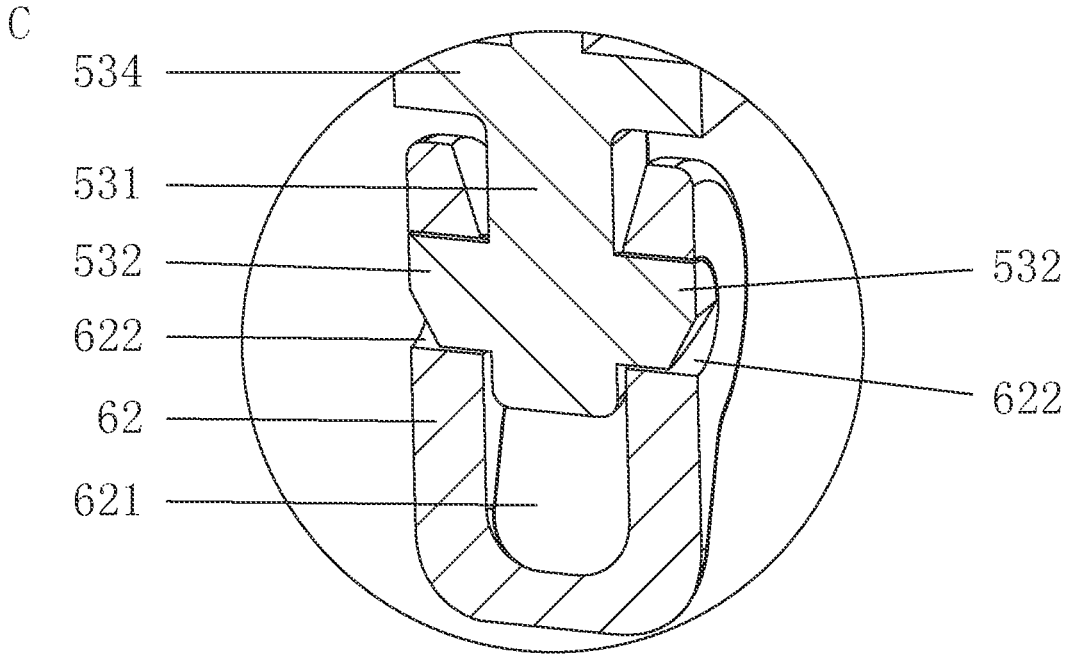
FIG. 10 is an enlarged schematic diagram of C in FIG. 9.
Figure 11:
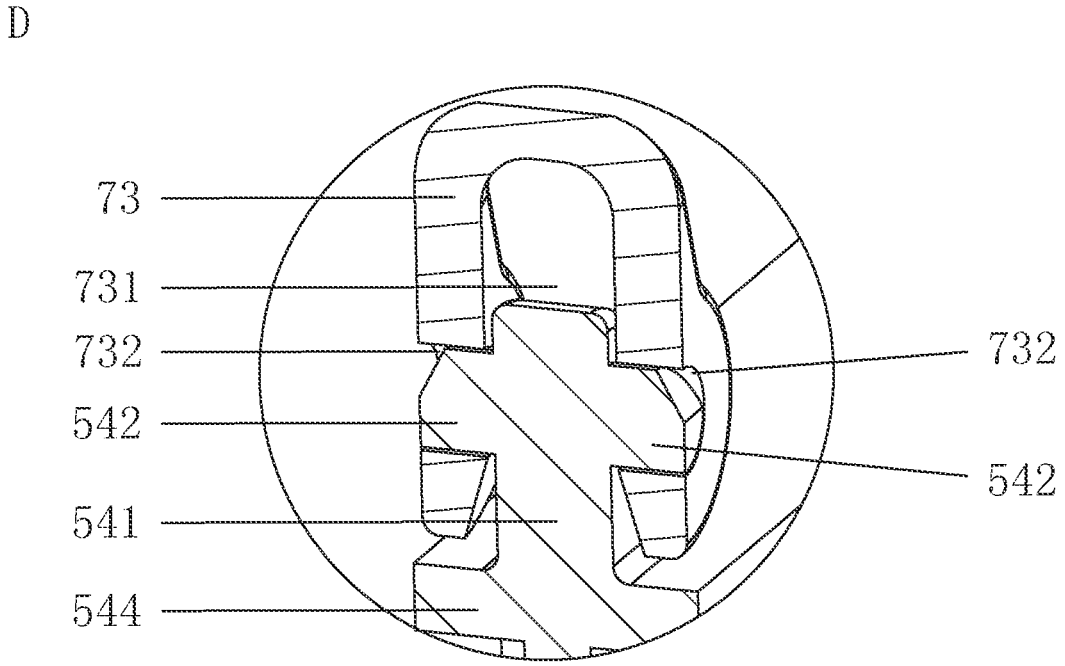
FIG. 11 is an enlarged schematic diagram of D in FIG. 9.
Figure 12:
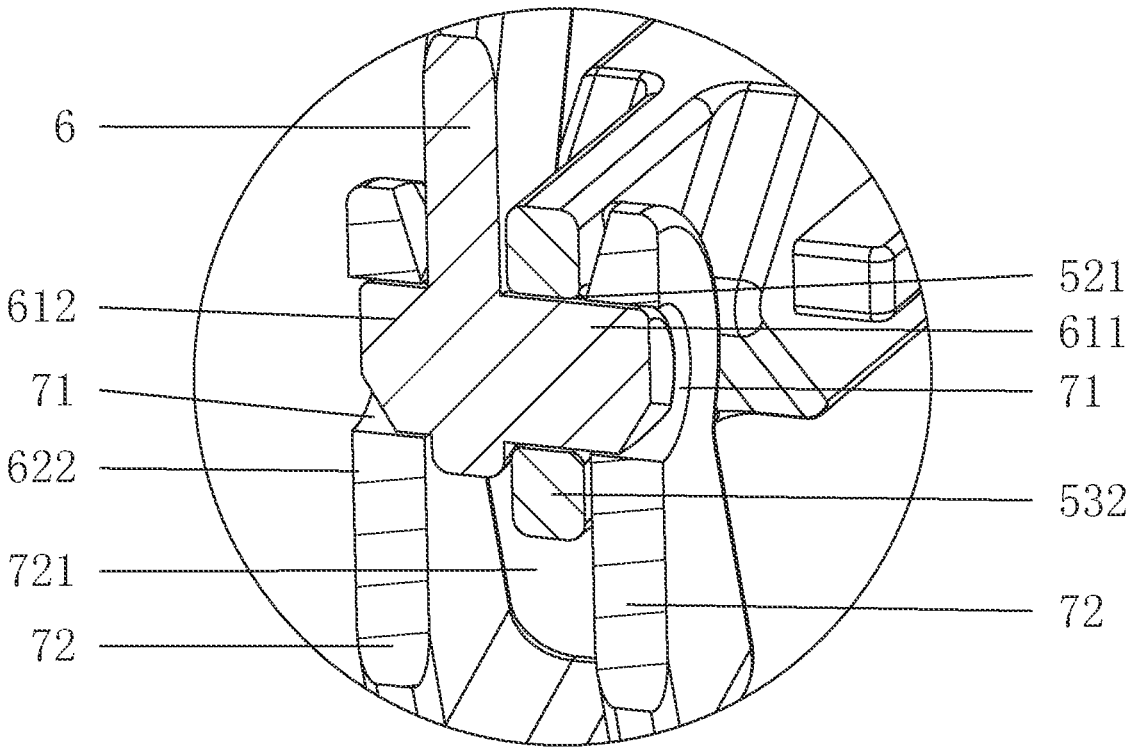
FIG. 12 is an enlarged schematic diagram of E in FIG. 9.
Figure 13:
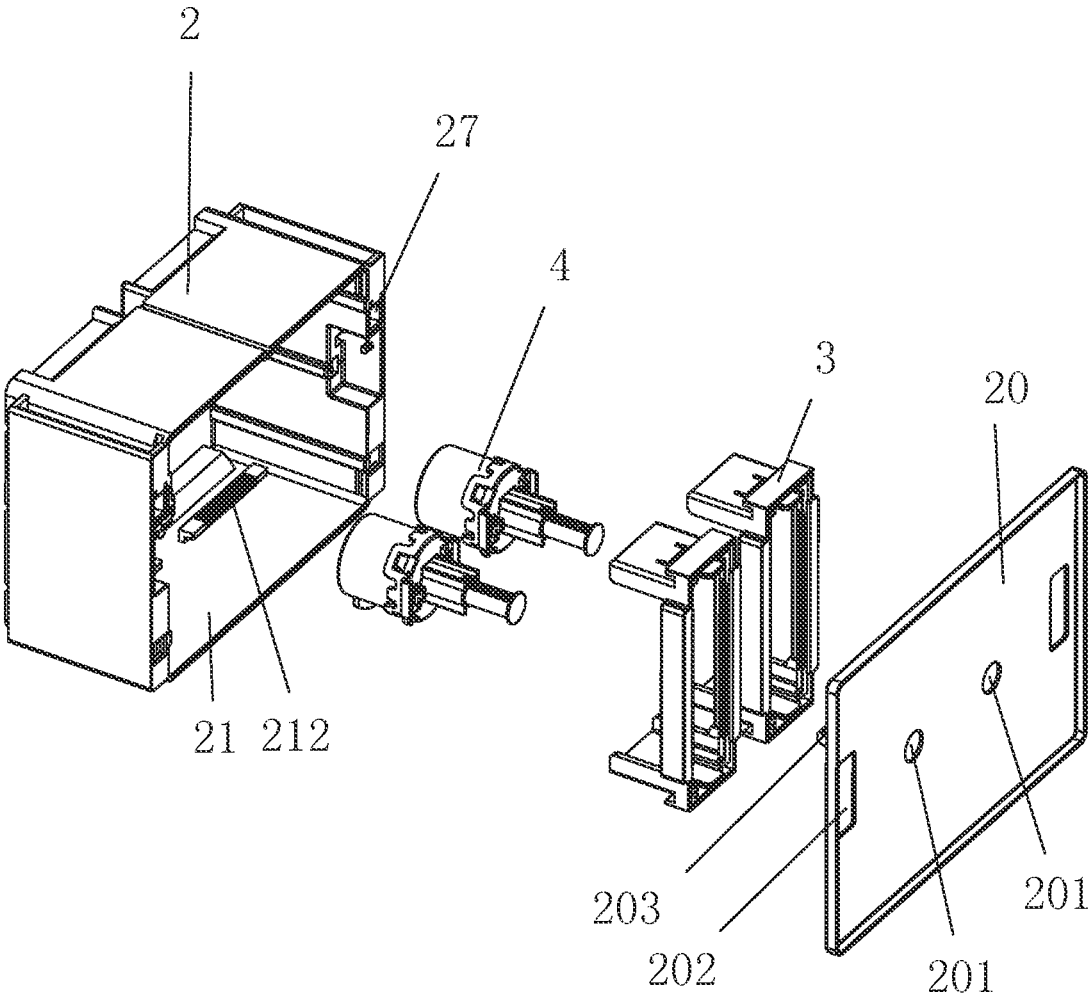
FIG. 13 is the second partial exploded view of the square outer cover.
Figure 14:
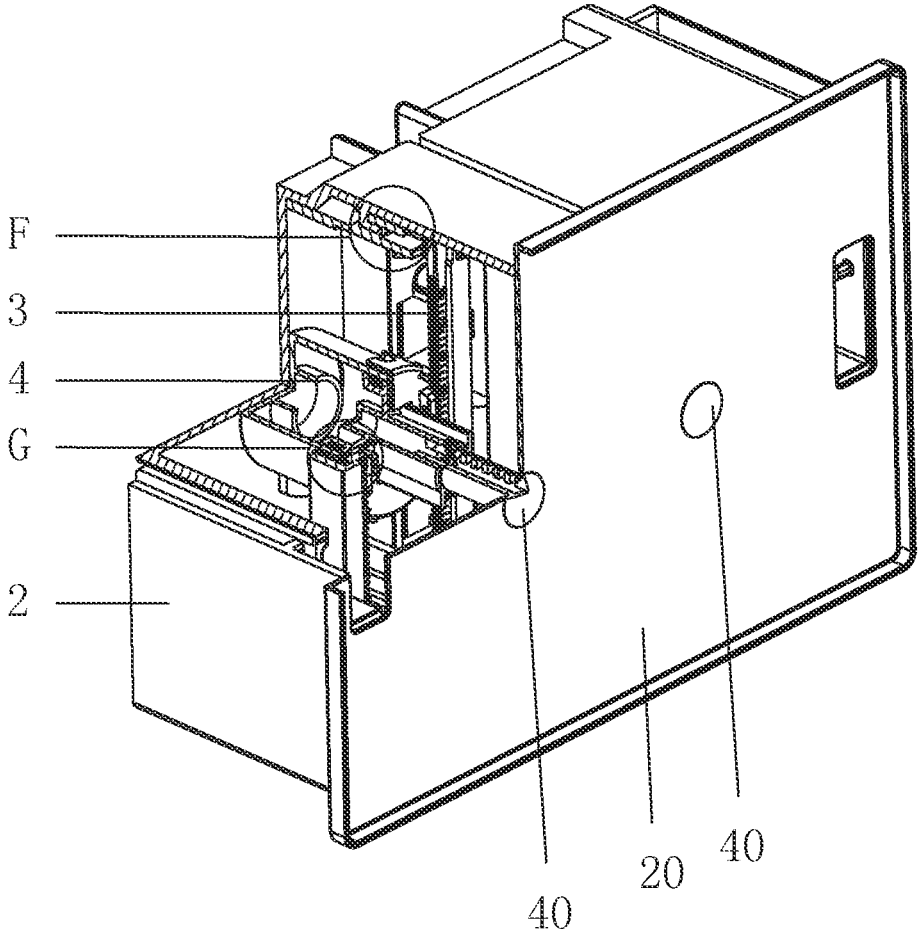
FIG. 14 is the first partial sectional views of the square outer cover.
Figure 15:
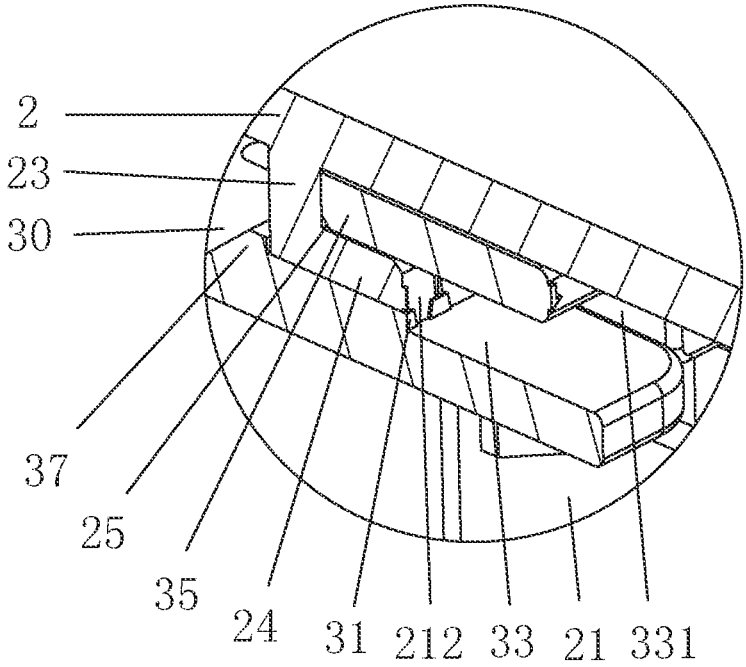
FIG. 15 is an enlarged schematic diagram of F in FIG. 14.
Figure 16:
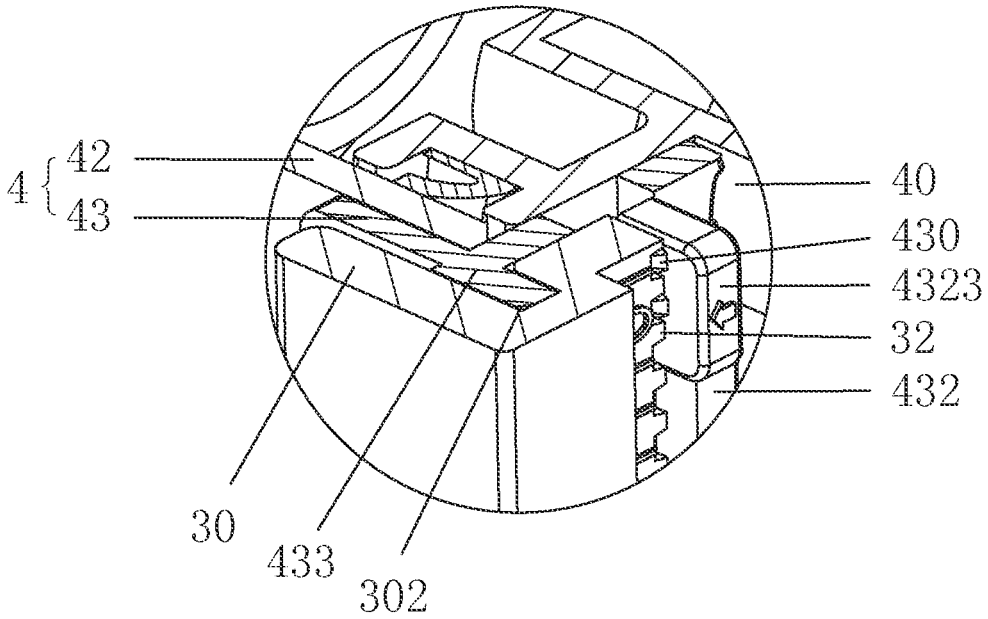
FIG. 16 is an enlarged schematic diagram of G in FIG. 14.
Figure 17:
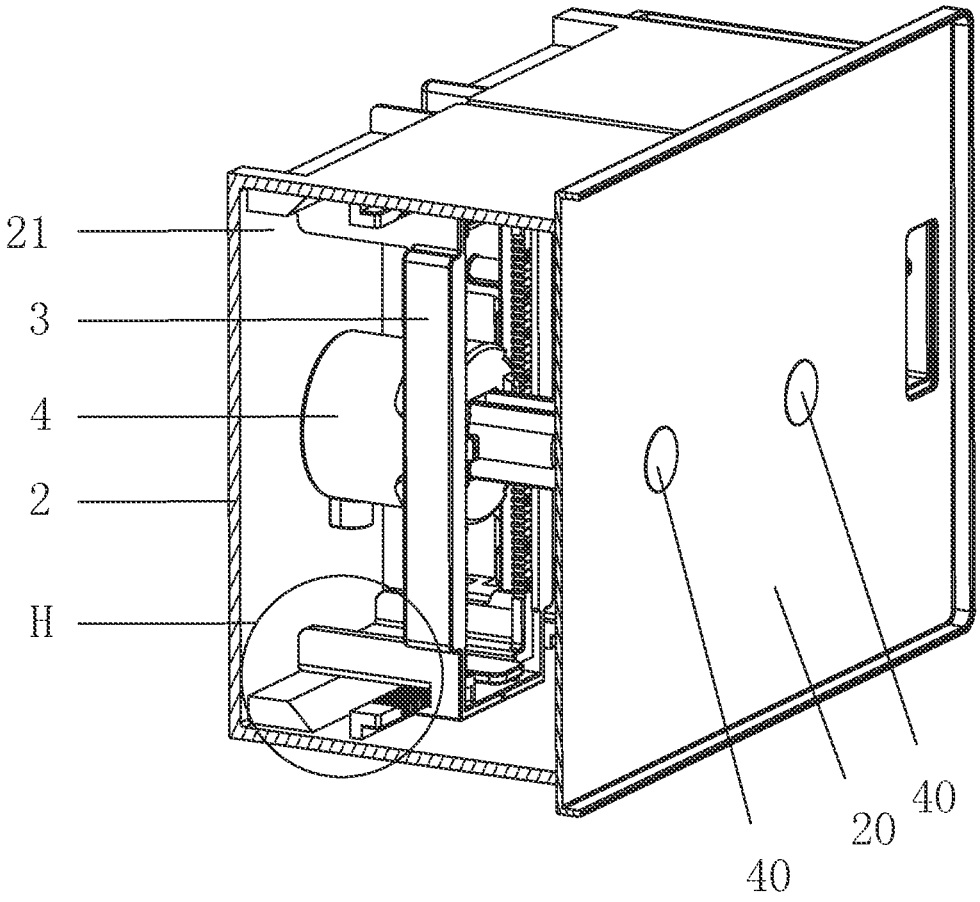
FIG. 17 is the second partial sectional view of the square outer cover.
Figure 18:
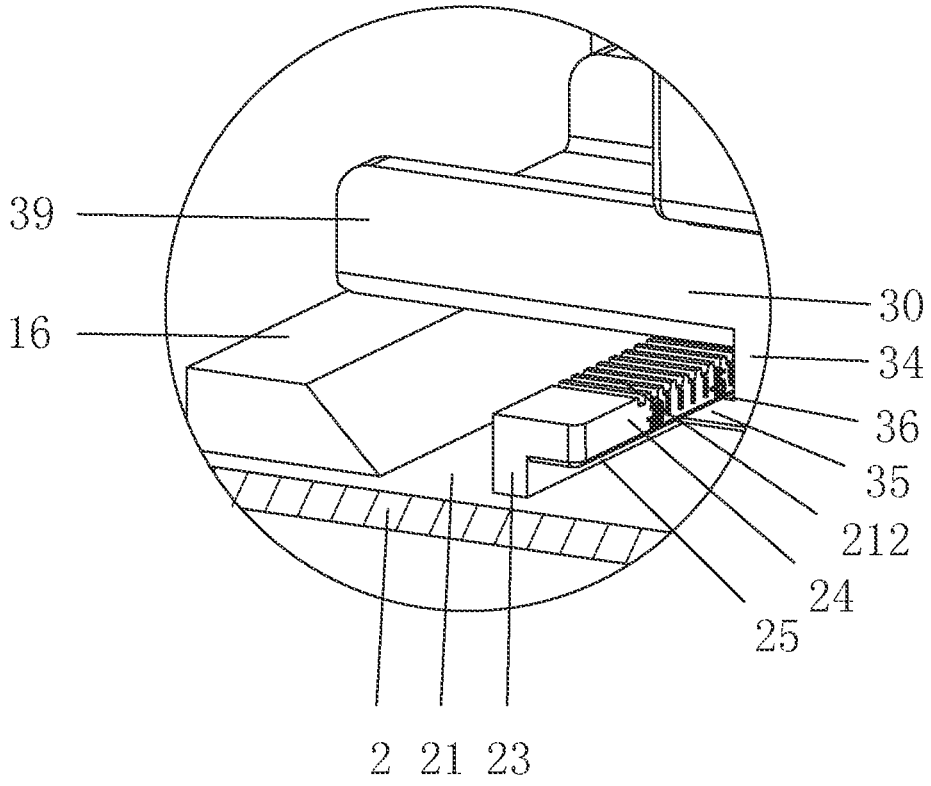
FIG. 18 is an enlarged schematic diagram of H in FIG. 17.
Figure 19:
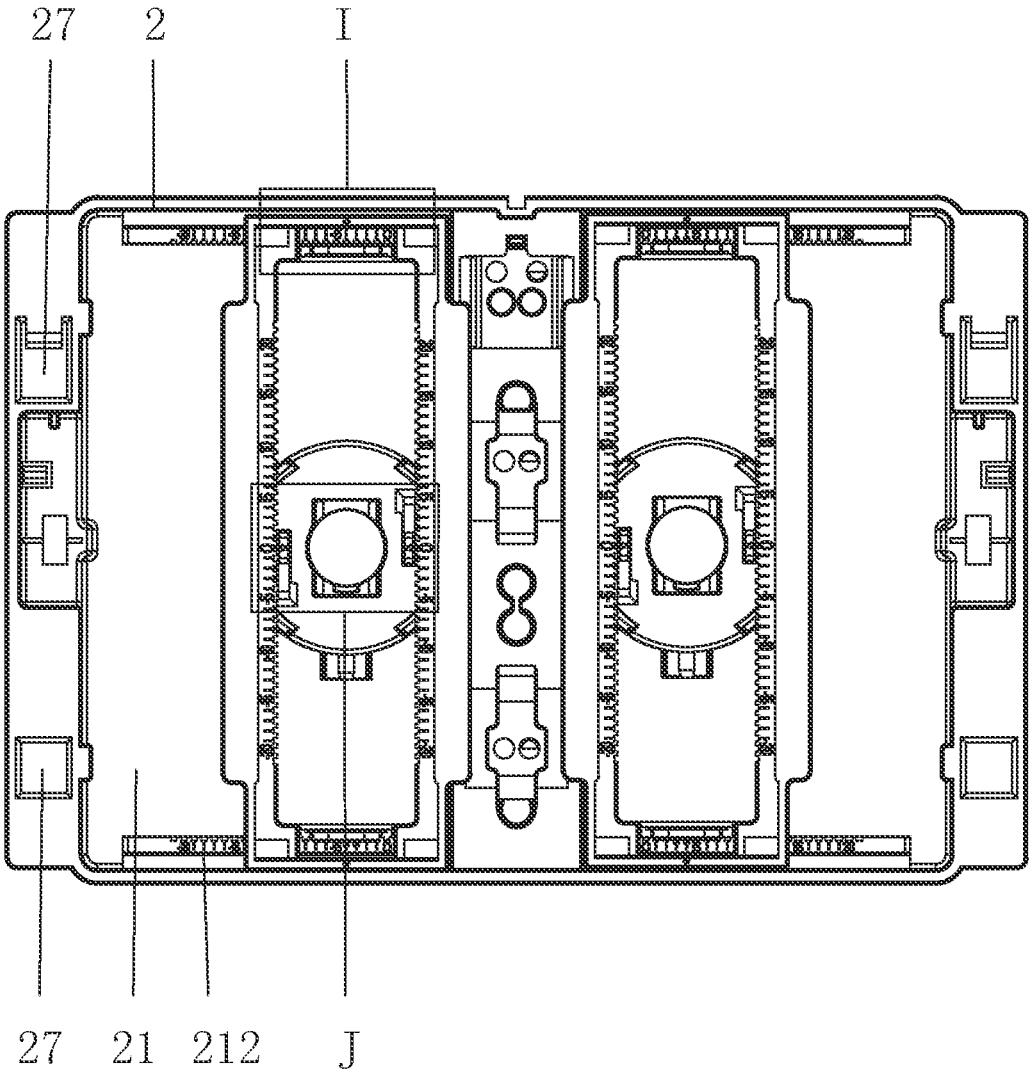
FIG. 19 is a front view of the square outer cover removing the decorative cover.
Figure 20:
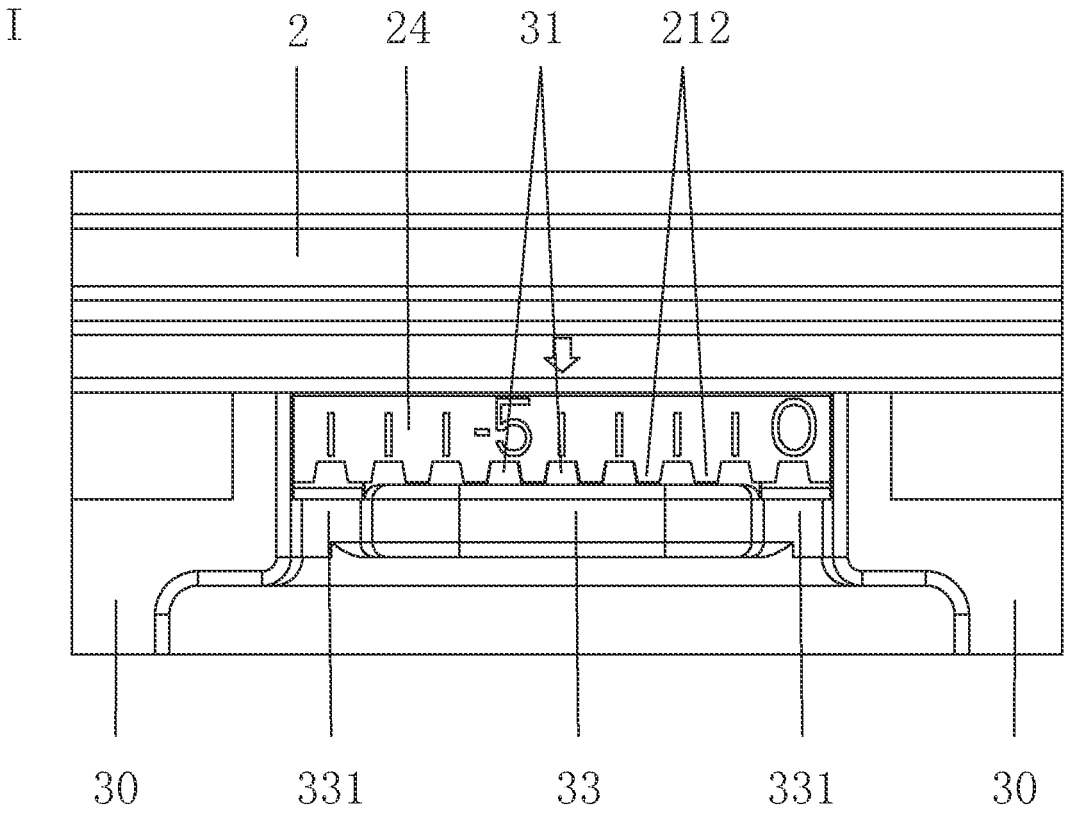
FIG. 20 is an enlarged schematic diagram of I in FIG. 19.
Figure 21:
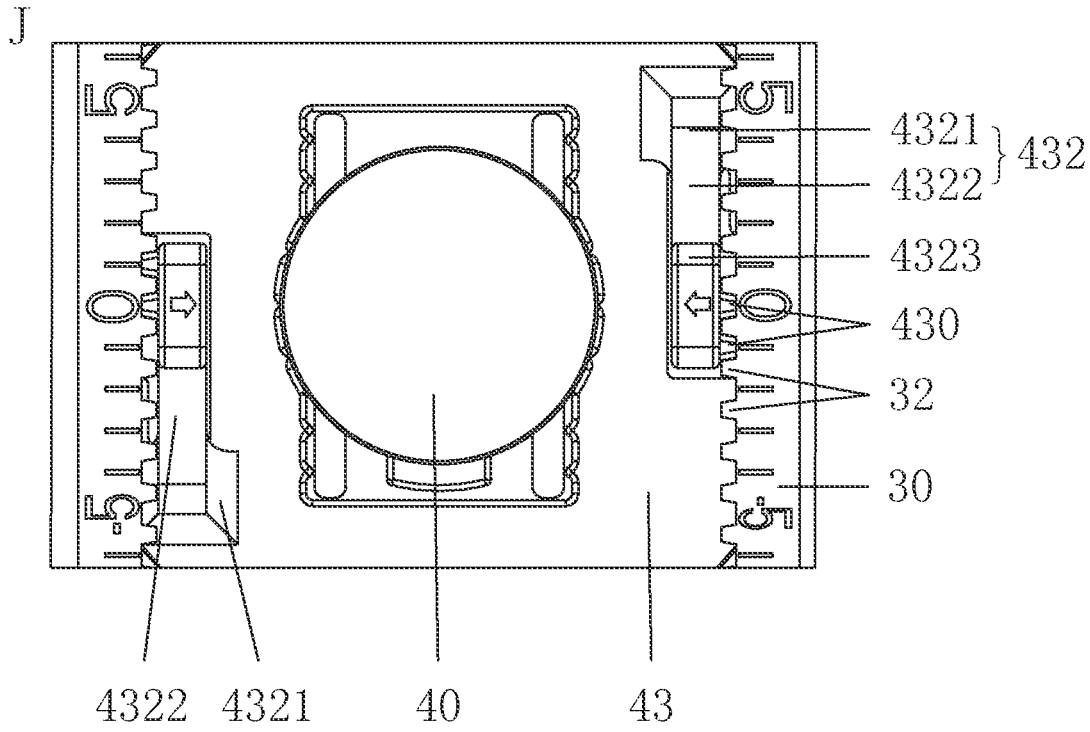
FIG. 21 is an enlarged schematic diagram of J in FIG. 19.
Figure 22:
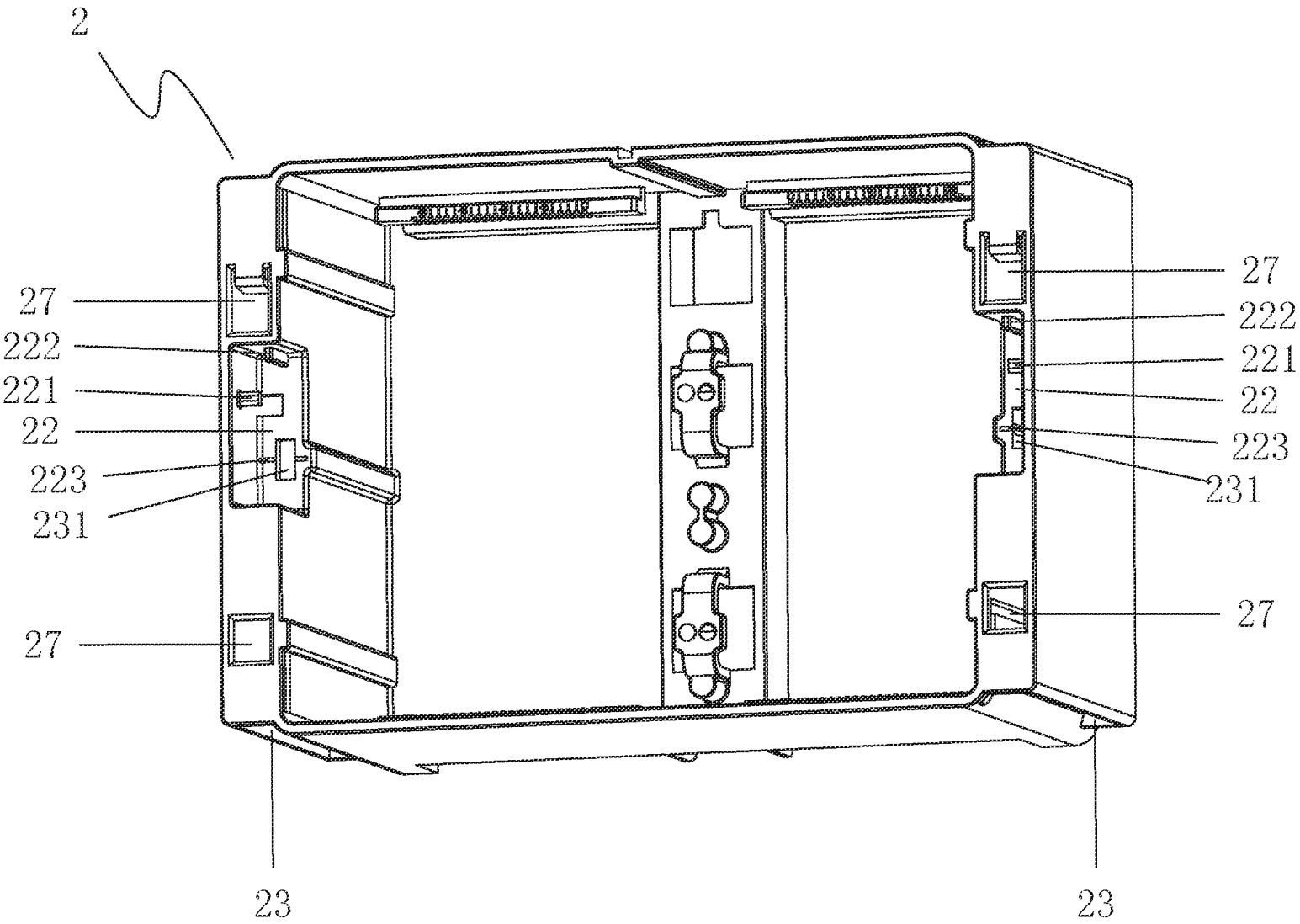
FIG. 22 is a structural diagram of the square outer cover.
Figure 23:
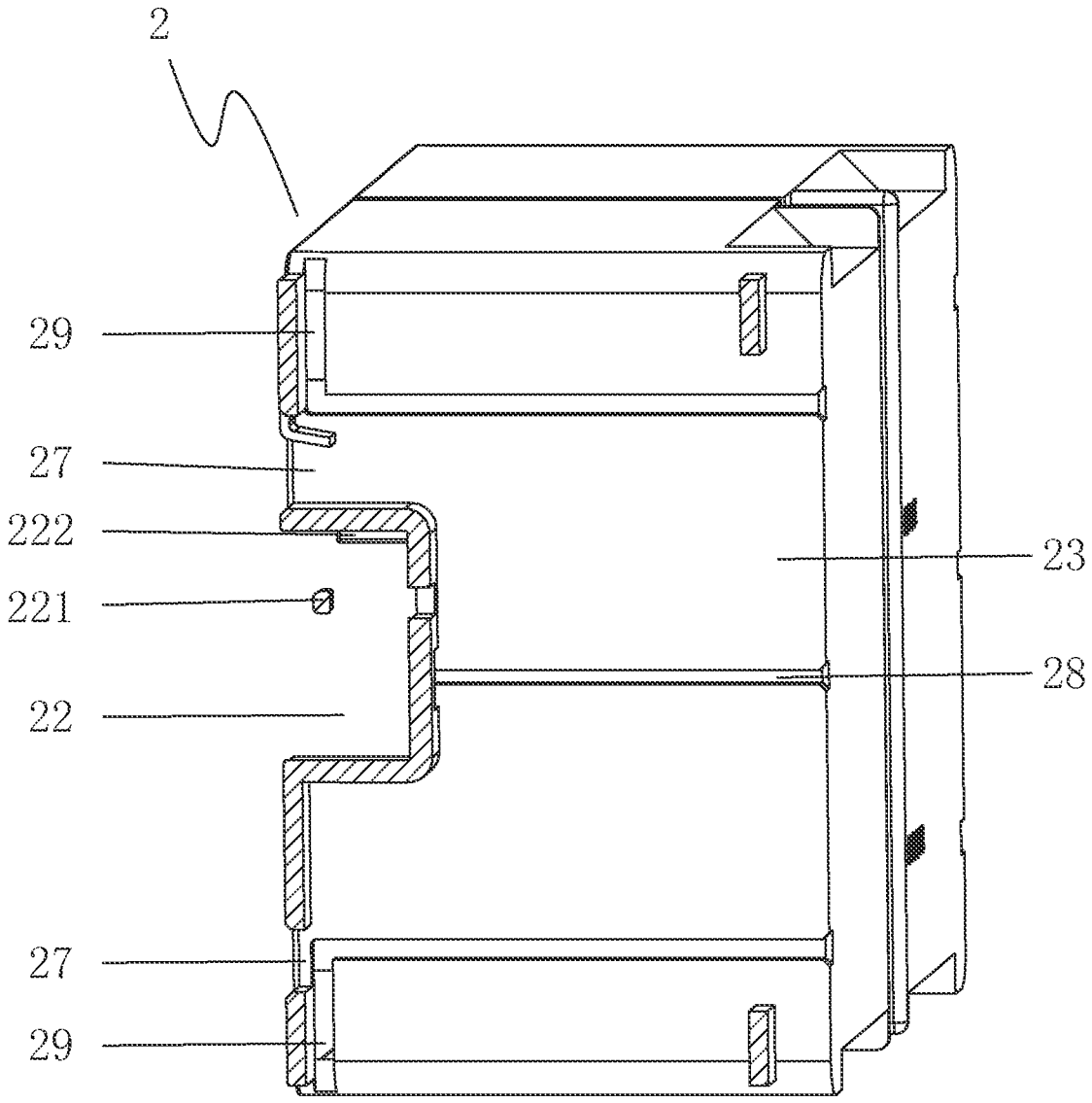
FIG. 23 is a sectional view of the square outer cover.
Figure 24:
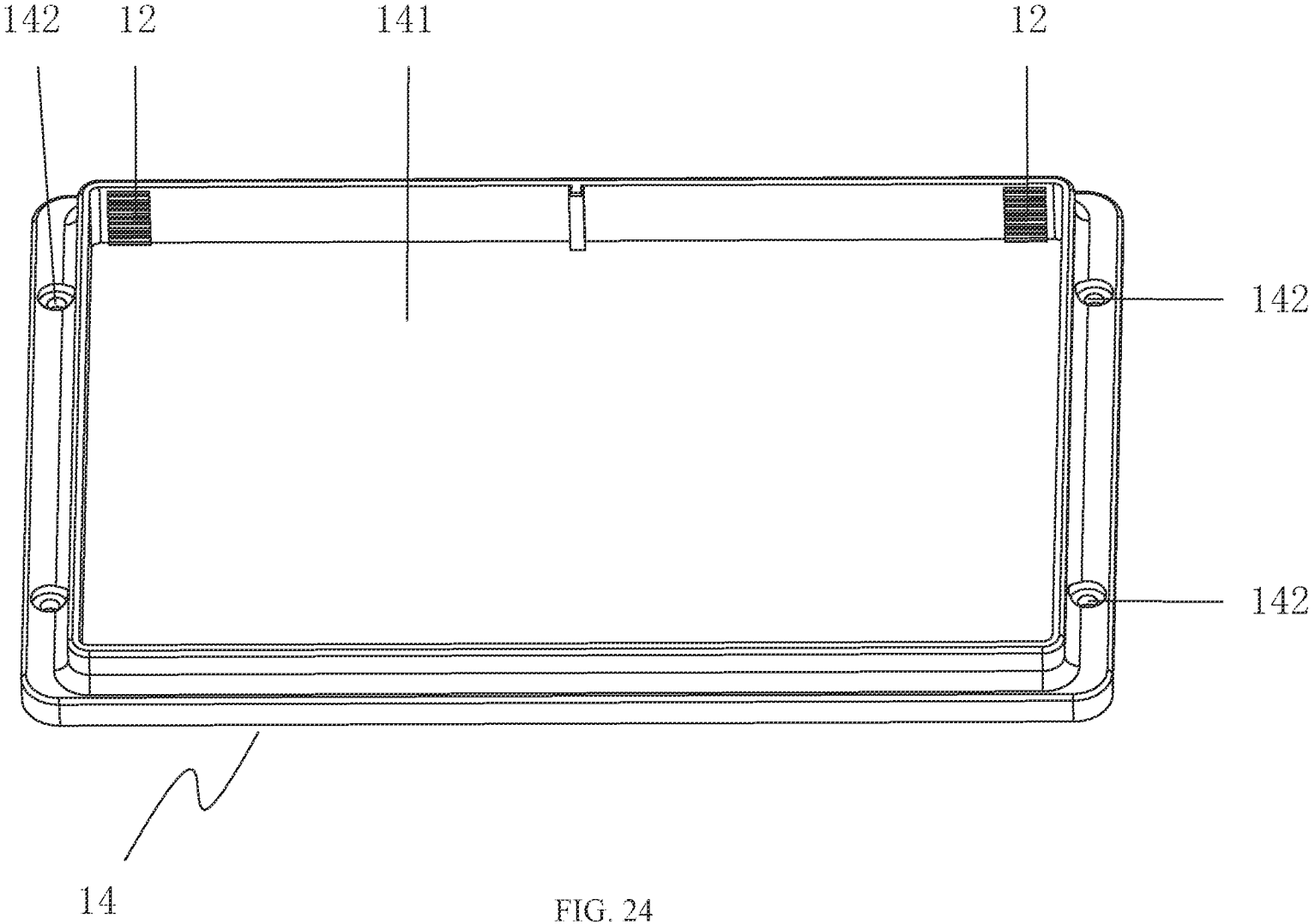
FIG. 24 is a structural diagram of a fixed support.
Figure 25:
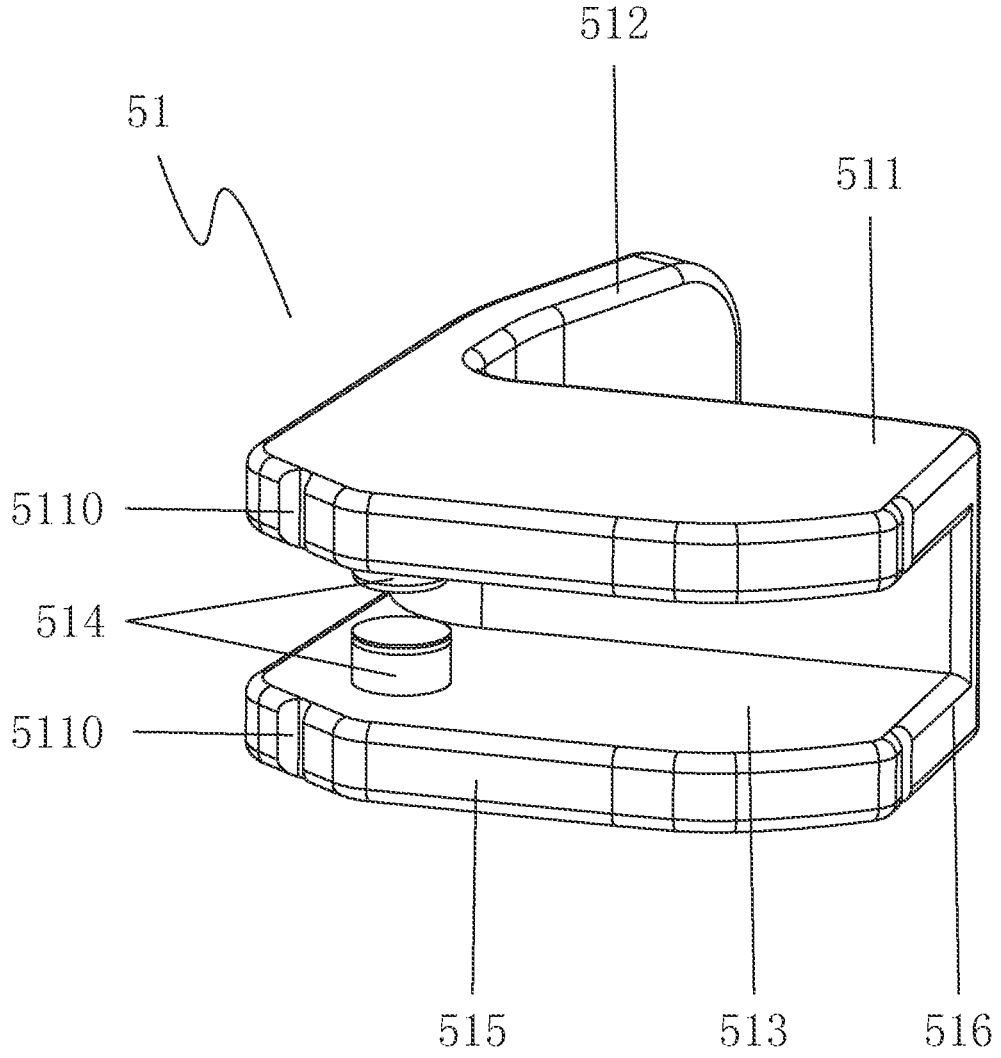
FIG. 25 is the first structural diagrams of handle.
Figure 26:
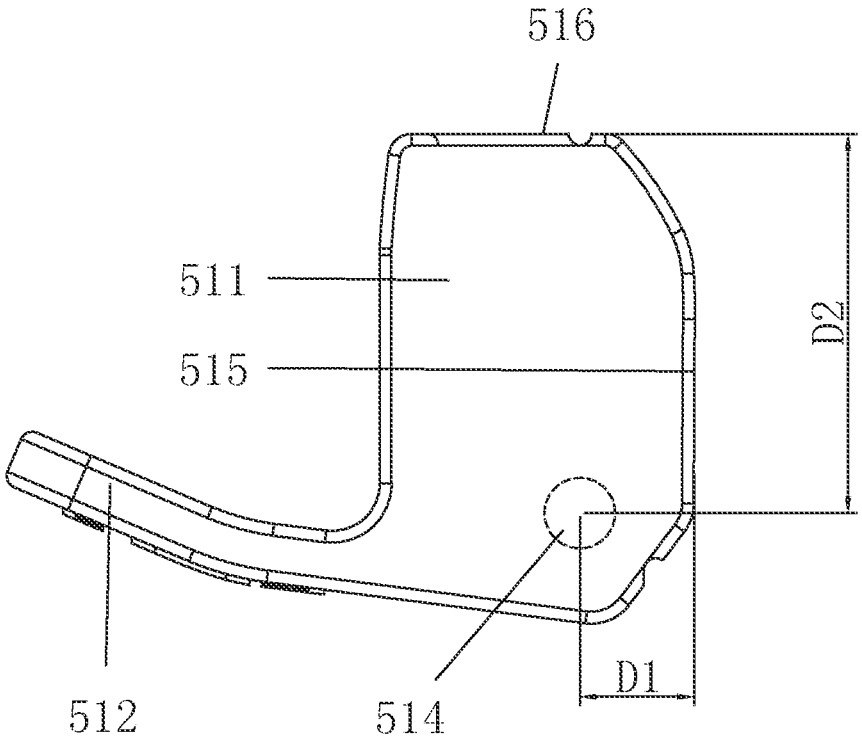
FIG. 26 is the second structural diagram of handle.
Figure 27:
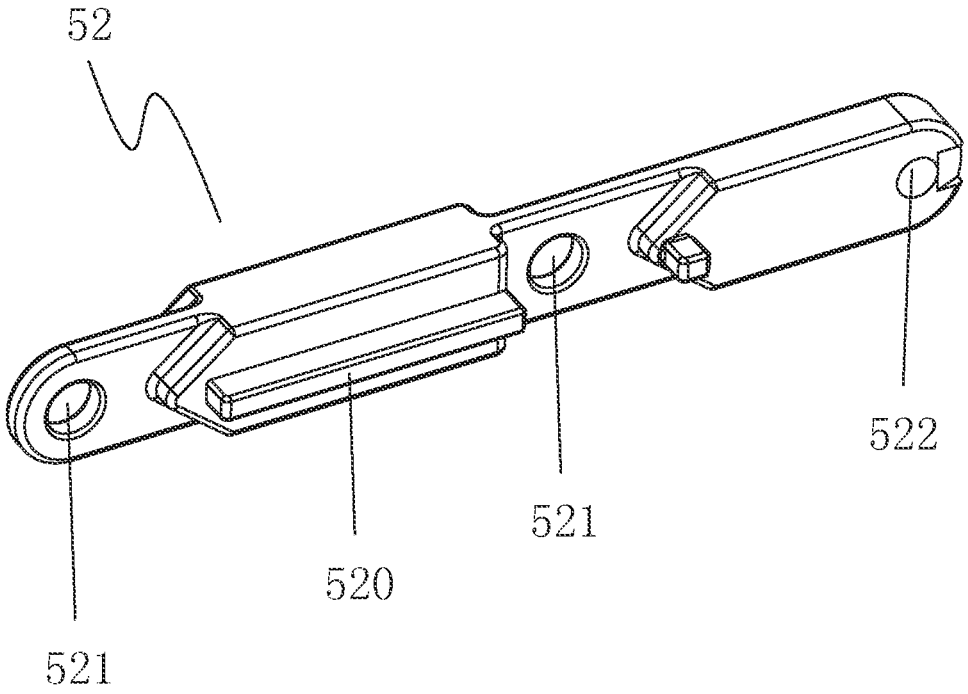
FIG. 27 is a structural diagram of a pull rod.
Figure 28:
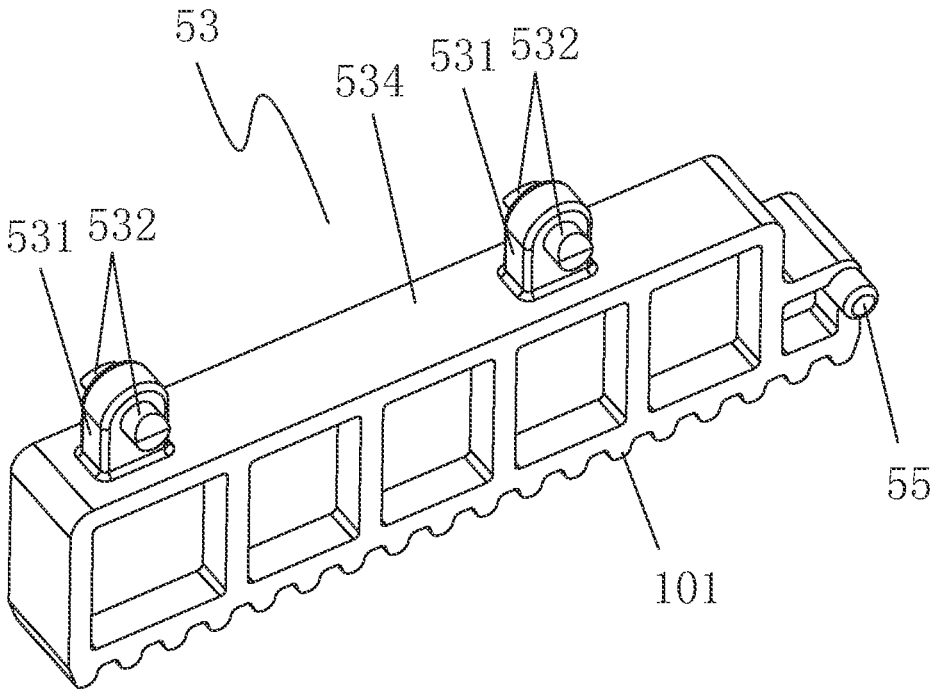
FIG. 28 is a structural diagram of the first locking block.
Figure 29:
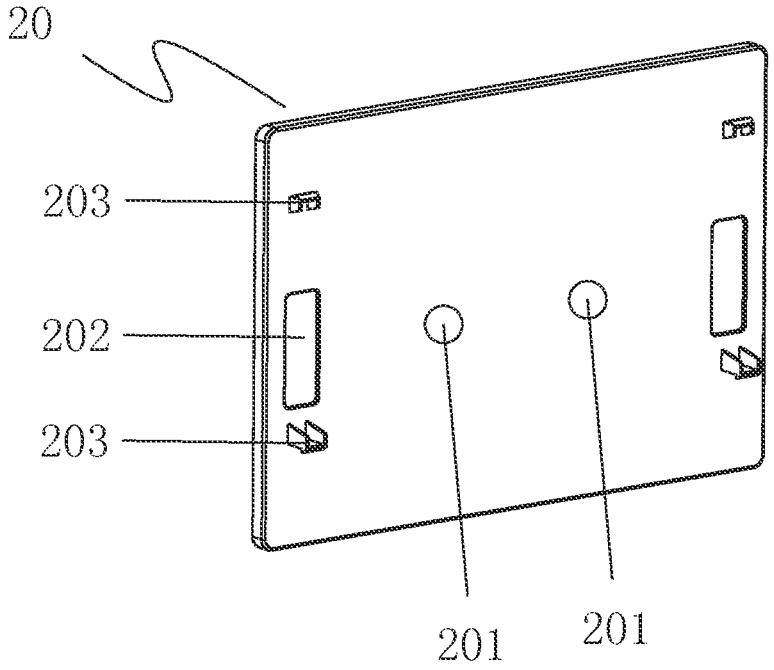
FIG. 29 is a structural diagram of the decorative cover.
Figure 30:
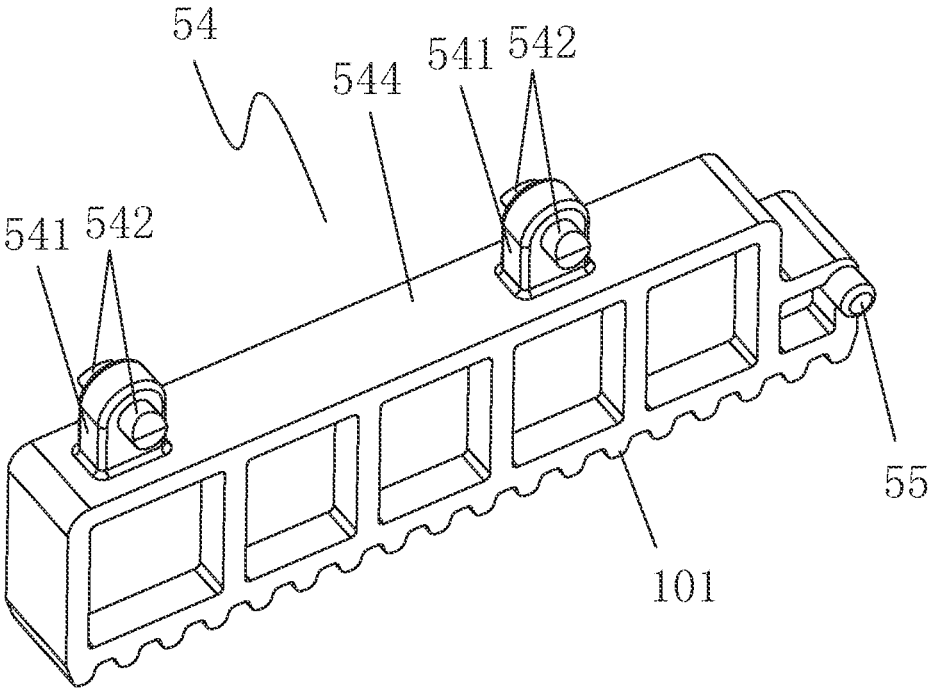
FIG. 30 is a structural diagram of the second locking block.
Figure 31:
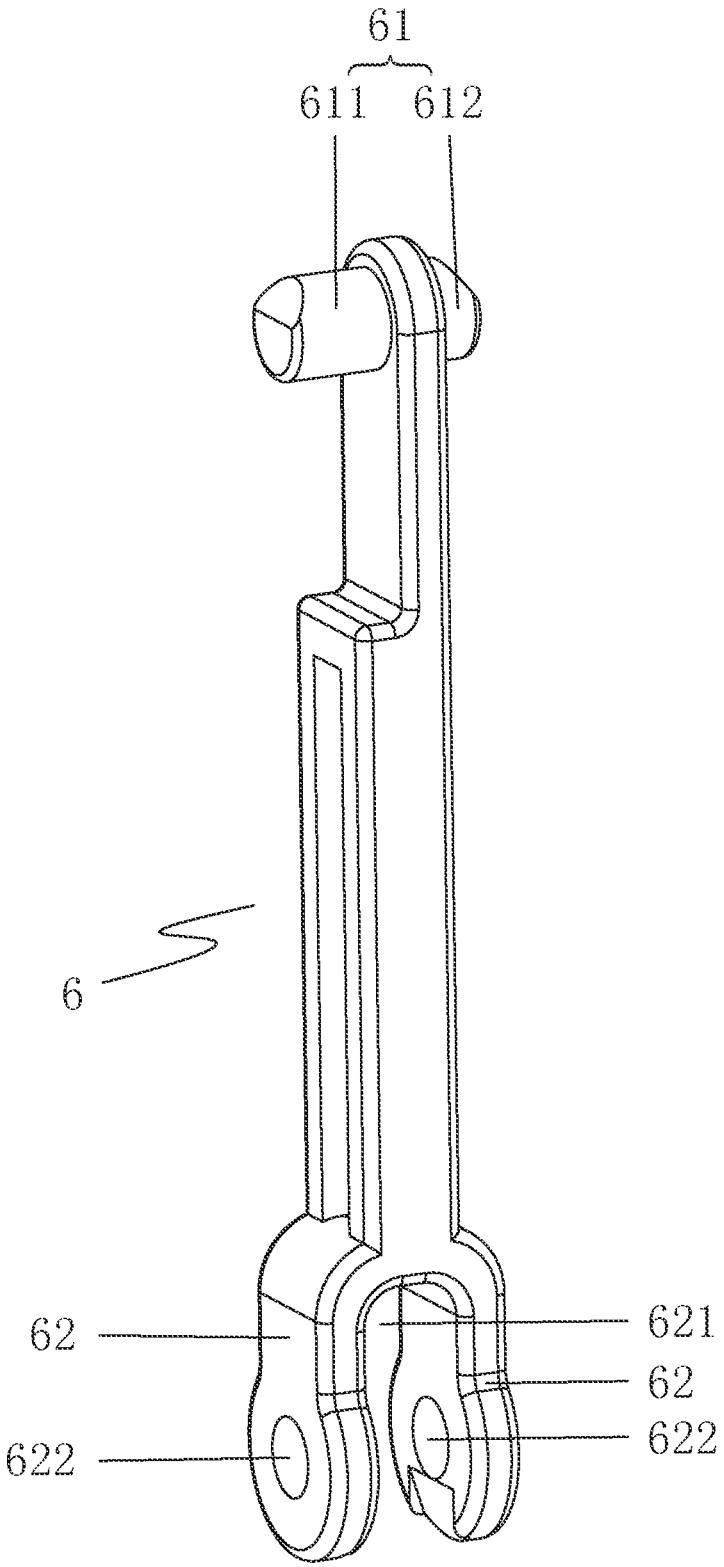
FIG. 31 is a structural diagram of the first connecting rod.
Figure 32:
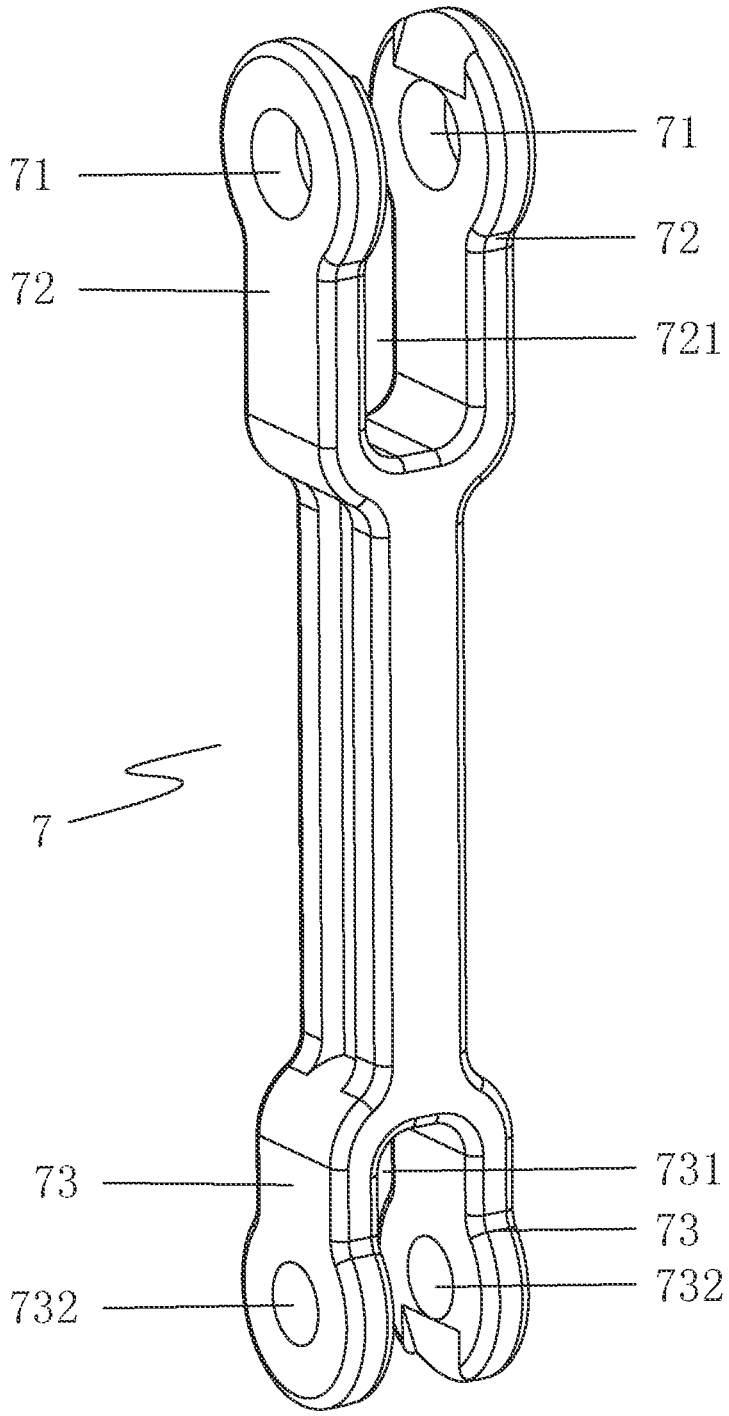
FIG. 32 is a structural diagram of the second connecting rod.
Figure 33:
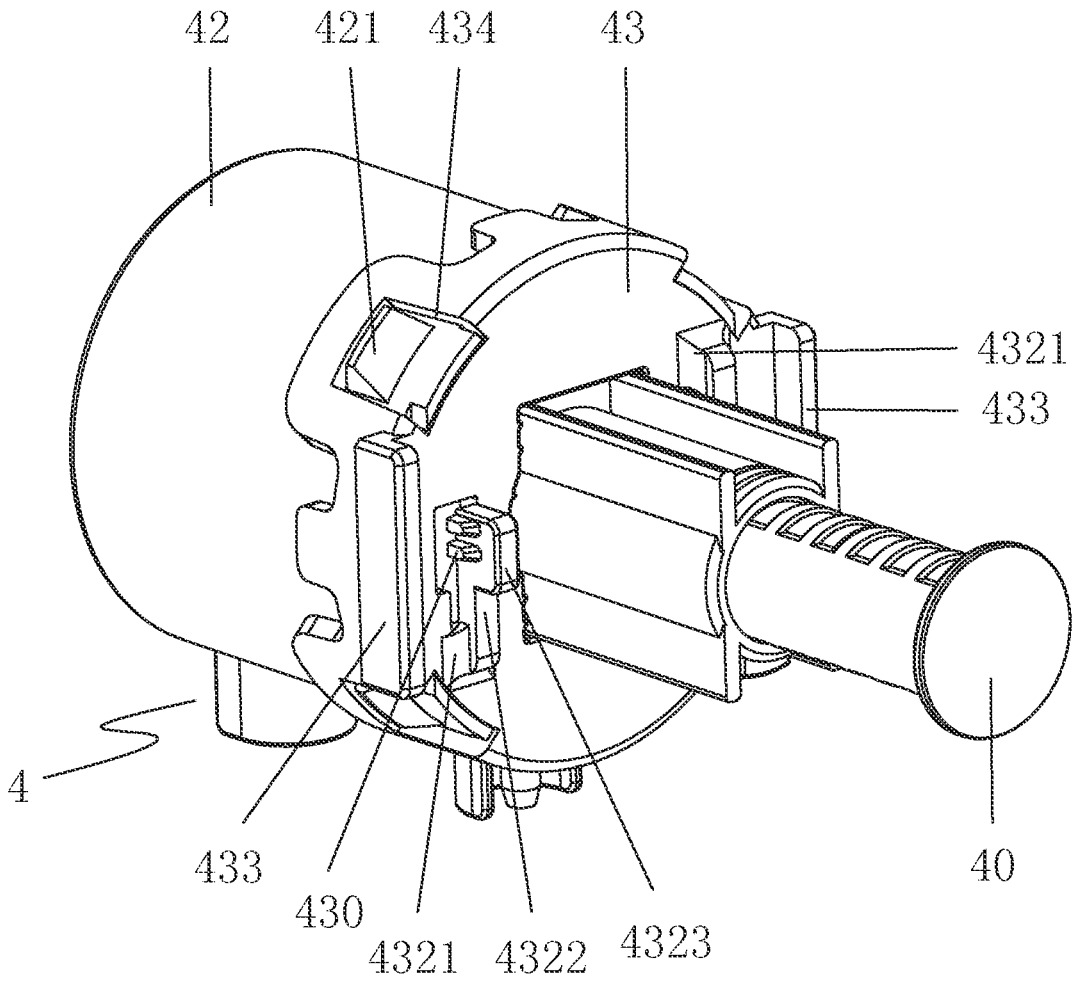
FIG. 33 is a structural diagram of a cylinder.
Figure 34:
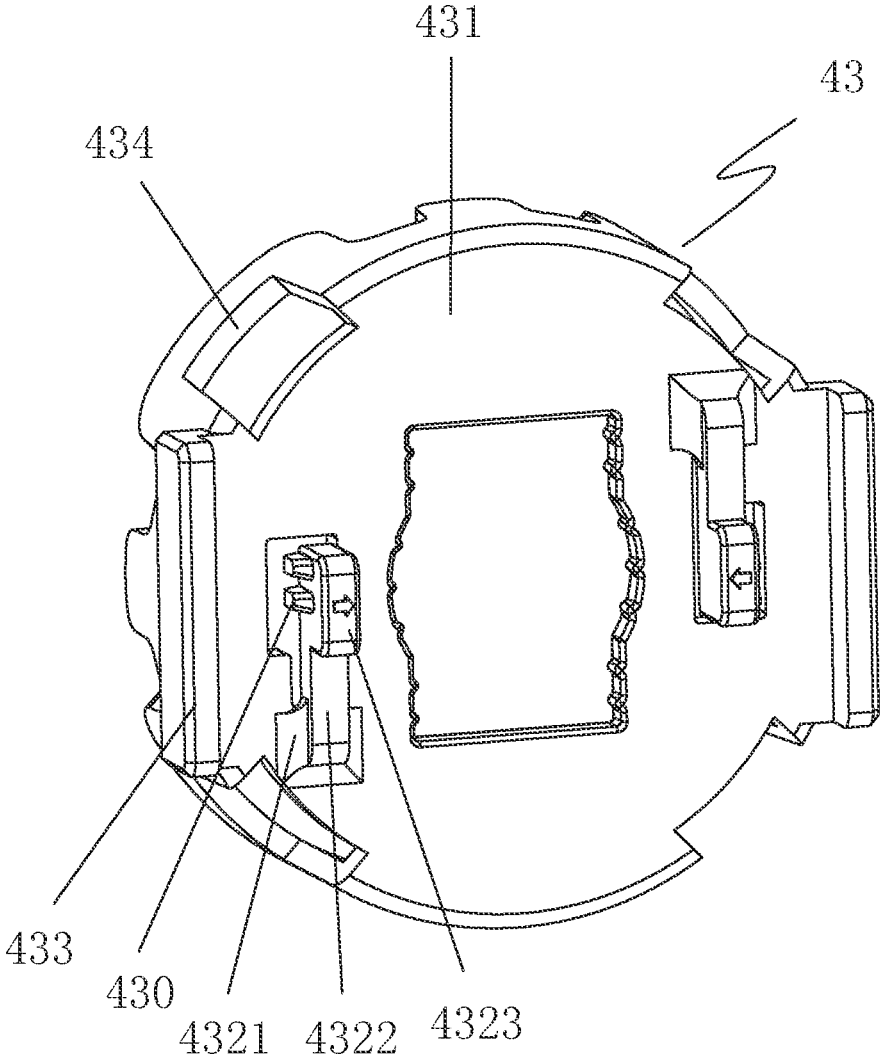
FIG. 34 is a structural diagram of the connecting cover.
Figure 35:
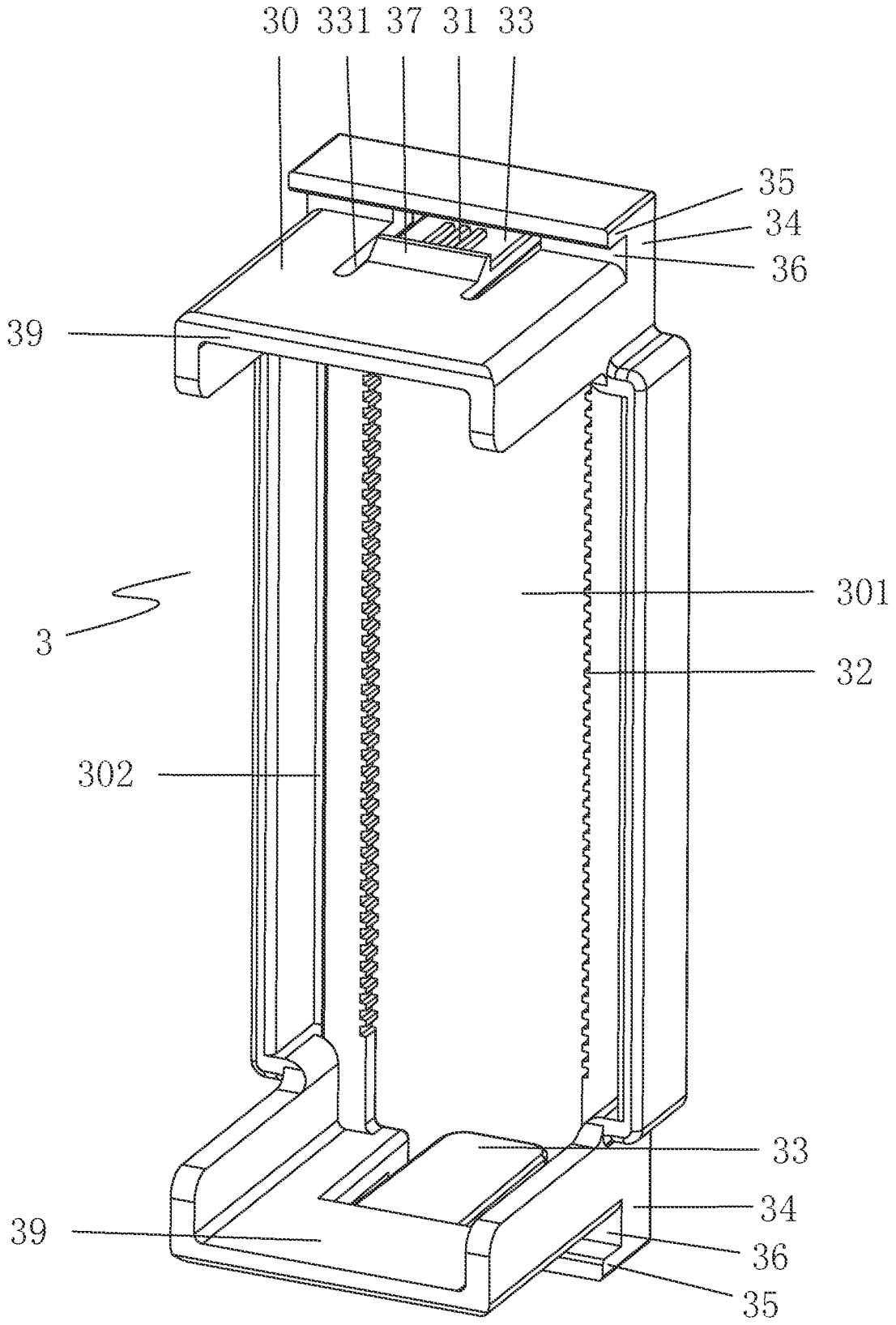
FIG. 35 is the first the structural diagrams of the support.
Figure 36:
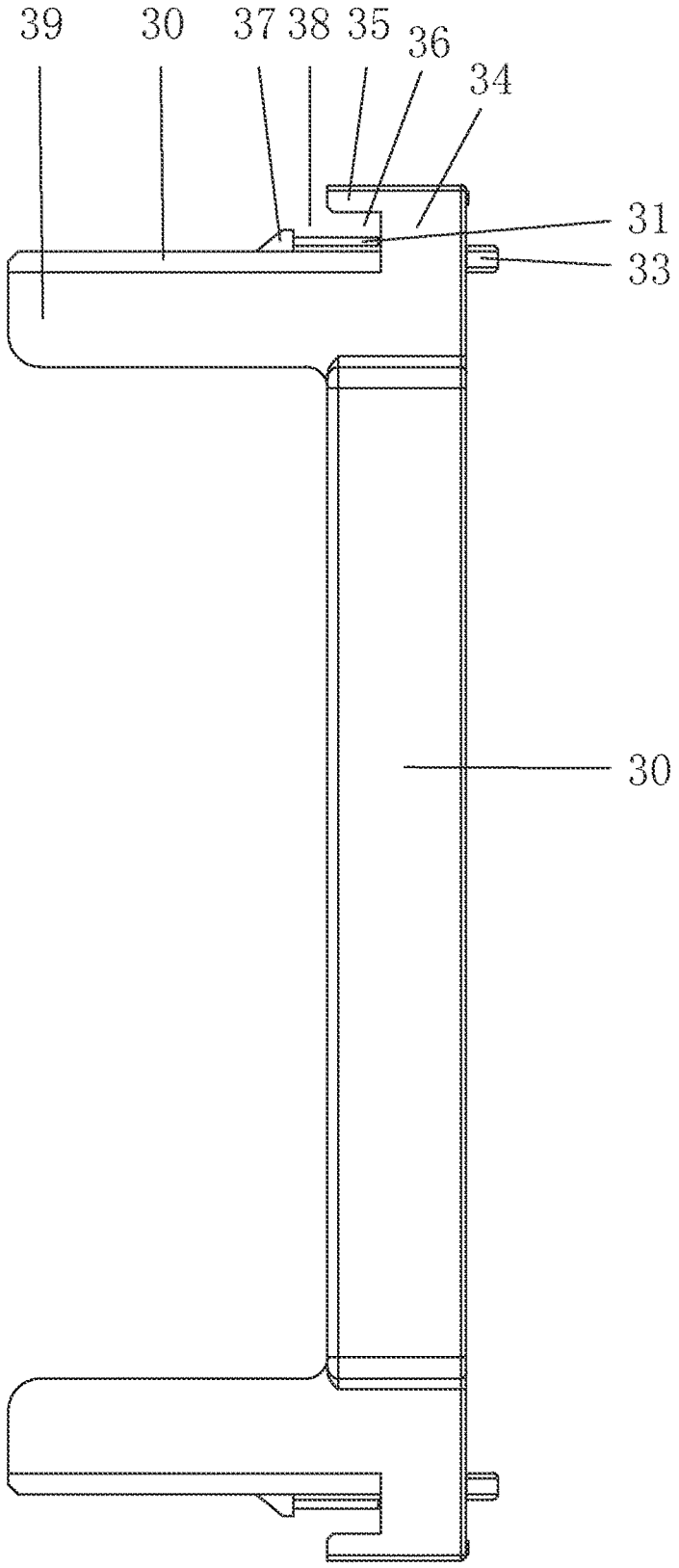
FIG. 36 is the second structural diagram of the support.

The disclosure is further described in detail below in combination with the accompanying drawings and specific embodiments:

As shown in FIG. 1 to FIG. 36, a square outer cover with built-in cylinder and adjustable height includes a water tank shell 1 and a square outer cover 2 movably arranged on the water tank shell 1, the water tank shell 1 is provided with an installation accommodation cavity 11 for containing the square outer cover 2. The water tank shell 1 is also provided with a support rack teeth 12, and a locking release device 100 is arranged in the square outer cover 2. The locking release device 100 includes a handle 51, a pull rod 52 hinged with the handle 51, a first locking block 53 and a second locking block 54 linked with the pull rod 52, and at least two first connecting rods 6 and at least two second connecting rods 7. Both the first locking block 53 and the second locking block 54 are provided with locking release rack teeth 101 matched with the support clamping teeth 12. The pull rod 52 is hinged with the first locking block 53 through two parallel first connecting rods 6, so that a parallelogram structure is formed between the pull rod 52, the first locking block 53 and the two first connecting rods 6 after assembly. The pull rod 52 is hinged with the second locking block 54 through two parallel second connecting rods 7, so that a parallelogram structure is formed between the pull rod 52, the second locking block 54 and the two second connecting rods 7 after assembly. The square outer cover 2 is provided with a first mounting cavity 21, the first mounting cavity 21 is also movably provided with a support 3 which can be adjusted laterally relative to it, the support 3 is movably provided with a cylinder 4 which can be adjusted longitudinally relative to it. And the locking release device 100 is adjusted to make the locking release rack teeth 101 and the support rack teeth 12 are disengaged, so as to adjust the distance of the square outer cover 2 extending out of the installation accommodation cavity 11. The locking release device 100 is adjusted to make the locking release rack teeth 101 and the support rack teeth 12 are out of engagement, so as to adjust the distance of the square outer cover 2 extending out of the installation accommodation cavity 11. It has the advantages of convenient adjustment, no cutting, reducing the use of tools, greatly reducing the manufacturing and installation cost, good applicability of the product, and the square outer cover can be taken out as a whole during the maintenance of the water tank, which is convenient for maintenance.

As shown in FIG. 1 to FIG. 12 and FIG. 22 to FIG. 32, when adjustment is required, the decorative cover 20 is clamped on the square outer cover 2, and the pull rod 52 is pulled by the handle 51 to translate towards both sides, the first connecting rod 6 and the second connecting rod 7 swing and drive the first locking block 53 and the second locking block 54 to retract inward, so that the locking release rack teeth 101 retract into the square outer cover 2. So that the locking release rack teeth 101 and the support rack teeth 12 are out of engagement, so as to adjust the square outer cover 2 to the flush position with the wall. The handle 51 is moved through the pull rod 52, the first connecting rod 6 and the second connecting rod 7 drive the first locking block 53 and the second locking block 54 to expand towards both ends, so that the locking release rack teeth 101 extend from the square outer cover 2 and engage with the support rack teeth 12 to complete the locking. At this time, the inner end face of the decorative cover 20 is fitted with the outer end face of the wall 8. Then, after fixing the square outer cover 2, the decorative cover 20 is removed, and the flushing panel is installed on the square outer cover 2, so that the flushing panel fits with the wall 8 to complete the installation of the toilet water tank. It has the advantages of convenient adjustment, no cutting, reducing the use of tools, greatly reducing the manufacturing and installation cost, good applicability of the product, and the square outer cover 2 can be taken out as a whole during the maintenance of the water tank, which is convenient for maintenance.

The cylinder 4 is provided with a pressing button 40, and the square outer cover 2 is also clamped with a decorative cover 20 for covering the first mounting cavity 21. The decorative cover 20 is provided with a button opening 201 for exposing the pressing button 40. Further, the function of the button opening 201 on the decorative cover 20 is to facilitate the adjustment of the cylinder 4 in the square outer cover 2, so that the pressing button 40 of the cylinder 4 is matched with the installation position of the flushing panel. The function of the decorative cover 20 is to replace the flushing panel during adjustment and installation, facilitate the adjustment of the square outer cover 2 to the flush position with the wall, reduce the inconvenience caused by disassembly and assembly of the flushing panel during adjustment and installation, and prevent damage to the flushing panel. Therefore, the disclosure can adjust the square outer cover 2 according to the decorative cover 20. Moreover, the cylinder 4 can be moved and adjusted along the longitudinal direction on the support 3, and the support 3 can be moved and adjusted along the transverse direction in the first mounting cavity 21, so that the square outer cover2 can be matched with more flushing panels.

As shown in FIG. 1 to FIG. 12 and FIG. 22 to FIG. 32, in this embodiment, one end of the first connecting rod 6 is hinged with the pull rod 52, the other end of the first connecting rod 6 is hinged with the first locking block 53, one end of the second connecting rod 7 is hinged with the pull rod 52, and the other end of the second connecting rod 7 is hinged with the second locking block 54, one end of the first connecting rod 6 is hinged with one end of the second connecting rod 7. When the pull rod 52 is pulled to translate towards both sides by the handle 51, the first connecting rod 6 and the second connecting rod 7 swing and drive the first locking block 53 and the second locking block 54 to expand to both ends or retract inward, so that the locking release rack teeth 101 extend out of the square outer cover 2 or retract into the square outer cover 2. One end of the first connecting rod 6 is provided with an articulated shaft 61, the articulated shaft 61 includes a first articulated shaft 611 and a second articulated shaft 612. The pull rod 52 is provided with a first pull rod hole 521 matched with the first articulated shaft 611, one end of the second connecting rod 7 is provided with a second connecting arm 72, and the second connecting arm 72 is provided with a connecting rod hinge hole 71 matched with the articulated shaft 61. A second accommodation cavity 721 for accommodating the pull rod 52 and the first connecting rod 6 when hinged is arranged between the two second connecting arms 72. The extension length of the first articulated shaft 611 from the outer end face of the first connecting rod 6 is greater than that of the second articulated shaft 612 from the outer end face of the first connecting rod 6, so that the first articulated shaft 611 passes through the first connecting rod hole 521 and is inserted into the connecting rod hinge hole 71 during assembly. The first locking block 53 includes a first locking body 534 and a raised first locking block connecting part 531 arranged on the first locking body 534. A raised first locking block hinge shaft 532 is arranged on the first locking block connecting part 531. The other end of the first connecting rod 6 is provided with a first connecting arm 62, and a first accommodation cavity 621 for accommodating the first locking block connecting part 531 when hinged is arranged between the two first connecting arms 62, and the first connecting arm 62 is provided with a first hinge hole 622 matched with the first locking block hinge shaft 532. The second locking block 54 includes a second locking body 544 and a raised second locking block connecting part 541 arranged on the second locking body 544, a raised second locking block hinge shaft 542 is arranged on the second locking block connecting part 541, and the other end of the second connecting rod 7 is provided with a third connecting arm 73. A third accommodation cavity 731 for accommodating the second locking block connecting part 541 when hinged is arranged between the two third connecting arms 73, and a third hinge hole 732 matched with the second locking block hinge shaft 542 is arranged on the third connecting arm 73. It has the advantages of simple structure, convenient connection, no need to use other parts for assembly, convenient and fast disassembly and assembly, and good articulated effect. At the same time, the articulated shaft and the hinge hole are provided with a guide sliding surface to facilitate the insertion of the articulated shaft into the hinge hole during hinge.

As shown in FIG. 1 to FIG. 12 and FIG. 22 to FIG. 32, in the present embodiment, the water tank shell 1 includes a shell body 13 and a fixed support 14 fixedly arranged on the shell body 13, the installation accommodation cavity 11 is arranged in the shell body 13, and the shell body 13 is provided with a shell opening 131. The fixed support 14 is provided with a support through hole 141 aligned with the shell opening 131 after assembly, and the support rack teeth 12 are symmetrically arranged on the inner wall of the support through hole 141. During locking, the locking release rack teeth 101 reach out from the square outer cover 2 and engage with the support rack teeth 12. When the lock is disengaged, the locking release rack teeth 101 are retracted into the square outer cover 2, so that the locking release rack teeth 101 and the support rack teeth 12 are disengaged, so as to adjust the distance of the square outer cover 2 extending out of the installation accommodation cavity 11. The fixed support 14 is provided with a support screw hole 142, the shell body 13 is provided with a shell screw hole 132 aligned with the support screw hole 142 after assembly, the fixed support 14 is fixedly connected with the shell body 13 through a fixed screw, and the fixed screw is threaded connected with the shell screw hole 132 after passing through the support screw hole 142. Further, the support rack teeth 12 can also be directly arranged on the shell body 13, and the support rack teeth 12 are symmetrically arranged on the inner walls at the upper and lower ends of the support through hole 141, which is convenient for fixing the square outer cover 2 at the upper and lower ends, and the installation is firm. After assembly, the square outer cover 2 is not easy to shake.

As shown in FIG. 1 to FIG. 12 and FIG. 22 to FIG. 32, in the present embodiment, the square outer cover 2 is also provided with a second mounting cavity 22 for the installation of the handle 51 and a third mounting cavity 23 for the installation of the locking release device 100. A connecting through hole 231 for the pull rod 52 to pass through after assembly is arranged between the third mounting cavity 23 and the second mounting cavity 22. The inner wall of the third mounting cavity 23 is provided with a transverse chute 28 and a longitudinal chute 29, the pull rod 52 is provided with a pull rod sliding strip 520 sliding in the transverse chute 28 after assembly, and the first locking block 53 and the second locking block 54 are provided with a locking block sliding strip 55 sliding in the longitudinal chute 29 after assembly. The decorative cover 20 is also provided with a handle opening 202 for exposing the handle 51. The decorative cover 20 is provided with a decorative cover buckle 203, and the square outer cover 2 is provided with a clamping groove 27 matched with the decorative cover buckle 203, so that the pull rod 52 can only move laterally in the third mounting cavity 23 and the first locking block 53 and the second locking block 54 can only move longitudinally in the third mounting cavity 23, limiting the moving direction of the pull rod 52, the first locking block 53 and the second locking block 54. According to the parallelogram principle, when the pull rod 52 is pulled by the handle 51 to translate towards both sides, the first locking block 53 and the second locking block 54 can expand to both ends or retract inward, and the side lengths of the two parallelogram structures are equal, so that the moving speed and distance of the first locking block 53 and the second locking block 54 expand to both ends or retract inward to are equal. It has advantages in simple mechanism, ingenious design and convenient adjustment.

As shown in FIG. 1 to FIG. 12 and FIG. 22 to FIG. 32, in this embodiment, the handle 51 includes a handle main body part 511 and a handle portion 512 integrally formed with the handle main body part 511, the pull rod 52 is also provided with a second pull rod hole 522, and a handle mounting cavity 513 is arranged in the handle main body part 511. The inner wall of the handle mounting cavity 513 is provided with a raised handle hinge shaft 514 matched with the second pull rod hole 522. The inner wall of the second mounting cavity 22 is respectively provided with a raised positioning column 221, a positioning strip 222 and a positioning flange 223, and the handle main body part 511 is provided with a positioning groove 5110 matched with the positioning flange 223. When the locking release device 100 is in a locked state, the end face of the handle portion 512 towards the handle main body part 511 is against the positioning strip 222, and the positioning groove 5110 is clamped in the positioning flange 223. When the locking release device 100 is in the unlocked state, the end face of the handle main body part 511 towards handle portion 512 is against the positioning column 221. When the positioning groove 5110 is clamped in the positioning flange 223, the handle 51 is to pull the pull rod 52 tightly, so that the first locking block 53 and the second locking block 54 remain expended towards both ends.

As shown in FIG. 1 to FIG. 12 and FIG. 22 to FIGS. 32, further, the handle 51 is also provided with an unlocking contact surface 515 against the inner wall of the second mounting cavity 22 when the locking release device 100 is in the unlocked state and a locking contact surface 516 against the inner wall of the second mounting cavity 22 when the locking release device 100 is in the locked state. The distance D1 between the handle hinge shaft 514 and the unlocking contact surface 515 is less than the distance D2 between the handle hinge shaft 514 and the locking contact surface 516, so that when the handle 51 locks the locking release device 100, the pull rod 52 is partially pulled into the second mounting cavity 22 by the handle 51. At this time, the length of the pull rod 52 pulled into the second mounting cavity 22 is greater than the length pulled into the second mounting cavity 22 when unlocking, so that the first connecting rod 6 and the second connecting rod 7 swing and drive the first locking block 53 and the second locking block 54 to expand towards both ends. When unlocking, most of the pull rod 52 returns into the first mounting cavity 21, causing the first connecting rod 6 and the second connecting rod 7 to swing towards one side of the handle 51 and drive the first locking block 53 and the second locking block 54 to close inward.

As shown in FIG. 13 to FIG. 21 and FIG. 33 to FIG. 36, in this embodiment, the first mounting cavity 21 is provided with a first clamping teeth 212, the support 3 includes a support body 30 and a support adjusting plate 33 whose one end is connected with the support body 30, and the outer end surface of the support adjusting plate 33 is provided with a second clamping teeth 31 matched with the first clamping teeth 212. A position avoidance groove 331 is also arranged between the support adjusting plate 33 and the support body 30. When the support adjusting plate 33 is moved, the second clamping teeth 31 are disengaged from the first clamping teeth 212, and the support 3 is moved laterally to adjust the relative position of the support 3 in the first mounting cavity 21. When there is a deviation in the installation of the flushing panel or the user changes the flushing panel, the position of the cylinder 4 in the first mounting cavity 21 can be adjusted, so that the pressing button 40 of the cylinder 4 for flushing is matched with the installation position of the flushing panel, the adjustment is simple and fast, and the adjustment can be completed by hand without other tools, which is convenient for the pressing button to adapt the installation position of the flushing panel. At the same time, it is also applicable to more flushing panels. Users can freely replace the flushing panels according to their own design and needs, and the user experience is good. At the same time, the adjustment is simple and fast, and the adjustment can be completed by hand without other tools. Further, the first clamping teeth 212 are symmetrically arranged on the inner walls of the upper and lower ends of the first mounting cavity 21, and the support 3 is correspondingly provided with two groups of second clamping teeth 31, so that both ends of the support 3 can be fixed after assembly to effectively prevent the support 3 from shaking.

As shown in FIG. 13 to FIG. 21 and FIG. 33 to FIG. 36, in this embodiment, a raised first clamping part 23 is arranged on the inner wall of the first mounting cavity 21, and the top of the first clamping part 23 extends to one side to form a second clamping part 24. A first clamping groove 25 is formed between one end of the second clamping part 24 and the inner wall of the first mounting cavity 21, and the other end of the second clamping part 24 is provided with the first clamping teeth 212. The support body 30 is located on the end face of one end of the support adjusting plate 33, and is also provided with a raised first connecting part 34. The top of the first connecting part 34 extends to one side to form a second connecting part 35 inserted into the first clamping groove 25 after assembly, and a first connecting groove 36 for inserting the second clamping part 24 after assembly is formed between the second connecting part 35 and the support body 30. The support adjusting plate 33 is located on one side of the second clamping teeth 31, and is also provided with a first bump 37, and a first holding groove 38 for accommodating the second clamping part 24 is formed between the first bump 37 and the first connecting part 34. When the support 3 moves laterally, the second clamping part 24 slides in the first holding groove 38.

As shown in FIG. 13 to FIG. 21 and FIG. 33 to FIG. 36, in the present embodiment, the end of the support body 30 away from the first connecting part 34 is also provided with an outward extending extension part 39, and the inner wall of the first mounting cavity 21 is provided with a raised first cushion block 16 for supporting the extension part 39. After assembly, the second clamping part 24 and the second connecting part 35 are engaged with each other, and there is also the support function of the extension 39 and the first cushion block 16, so that the support 3 is firmly installed in the first mounting cavity 21 after assembly. At the same time, when the support 3 is moved laterally to adjust the relative position of the support 3 in the first mounting cavity 21, the support 3 moves smoothly. Further, the first mounting cavity 21 is provided with at least two cylinders 4 and at least two supports 3, and the second clamping part 24 is also provided with a scale to facilitate the adjustment of the support 3. During the adjustment, the user can visually observe the position of the support 3.

As shown in FIG. 13 to FIG. 21 and FIG. 33 to FIG. 36, in this embodiment, the support body 30 is provided with an adjusting cavity 301, the inner wall of the adjusting cavity 301 is provided with a third clamping teeth 32, and the cylinder 4 includes a cylinder body 42 and a connecting cover 43 arranged on the cylinder body 42. The connecting cover 43 includes a connecting cover body 431 and a cylinder adjusting plate 432 whose one end is connected with the connecting cover body 431. The outer end face of the cylinder adjusting plate 432 is provided with a fourth clamping teeth 430 matched with the third clamping teeth 32. The connecting cover body 431 is also provided with positioning strip 433 on both sides of the cylinder adjusting plate 432, and the support body 30 is also provided with a chute 302 matched with the positioning strip 433. The connecting cover 43 is provided with a connecting through hole 434, and the cylinder body 42 is provided with a cylinder buckle 421 matched with the connecting through hole 434. When the support adjusting plate 33 is moved, the fourth clamping teeth 430 is out of engagement from the third clamping teeth 32, and the cylinder 4 is moved longitudinally to adjust the relative position of the cylinder 4 in the support 3. The cylinder adjusting plate 432 includes an adjusting plate connecting part 4321 fixedly connected with the connecting cover body 431 and an elastic part 4322 integrally formed with the adjusting plate connecting part 4321. An avoidance space is formed between the elastic part 4322 and the connecting cover body 431, and the end face of the elastic part 4322 far away from the connecting cover body 431 extends outward to form a handle portion 4323. When the handle portion 4323 is moved so that the fourth clamping teeth 430 is out of engagement from the third clamping teeth 32, the cylinder 4 is moved longitudinally, so as to adjust the relative position of the cylinder 4 on the support 3. Further, the third clamping teeth 32 are symmetrically arranged on the side walls at the left and right ends of the adjusting cavity 301, and the cylinder 4 is correspondingly provided with two groups of fourth clamping teeth 430, so that both sides of the cylinder 4 can be fixed after assembly to effectively prevent the cylinder 4 from shaking. The positioning strip 233 and the chute 302 cooperate with each other to fix the cylinder 4 in the circumferential direction and facilitate the longitudinal movement of the cylinder 4, so as to adjust the relative position of the cylinder 4 on the support 3. The adjustment is simple and fast, and can be completed by hand without other tools. The support body 30 is also provided with a scale to facilitate the adjustment of cylinder 4. During the adjustment, the user can visually observe the position of cylinder 4.

What is claimed is:

1. An adjustable height square outer cover with a built-in cylinder, comprising a water tank shell and a square outer cover movably arranged on the water tank shell, wherein the water tank shell is provided with an installation accommodation cavity containing the square outer cover, the water tank shell is also provided with support rack teeth, the square outer cover is provided with a locking release device; the locking release device comprises a handle, a pull rod hinged with the handle, a first locking block, a second locking block, at least two first connecting rods and at least two second connecting rods, wherein the first locking block and the second locking block are linked with the pull rod; the first locking block and the second locking block are respectively provided with locking release rack teeth matched with the support rack teeth; the pull rod is hinged with the first locking block through two parallel first connecting rods, wherein a first parallelogram structure is formed between the pull rod, the first locking block and the two parallel first connecting rods after assembly; the pull rod is hinged with the second locking block through two parallel second connecting rods, wherein a second parallelogram structure is formed between the pull rod, the second locking block and the two parallel second connecting rods after assembly; a first mounting cavity is provided inside the square outer cover, the first mounting cavity is movably provided with a support configured to adjust laterally relative to the first mounting cavity, the support is movably provided with a cylinder configured to adjust longitudinally relative to the support, and the locking release device is adjusted, wherein the locking release rack teeth and the support rack teeth are out of engagement, wherein a distance of the square outer cover extending out of the installation accommodation cavity is adjusted.

2. The adjustable height square outer cover with the built-in cylinder according to claim 1, wherein a first end of the first connecting rod is hinged with the pull rod, a second end of the first connecting rod is hinged with the first locking block, and a first end of the second connecting rod is hinged with the pull rod, a second end of the second connecting rod is hinged with the second locking block, and the first end of the first connecting rod is hinged with the first end of the second connecting rod; when the pull rod is pulled to translate towards both sides by the handle, the first connecting rod and the second connecting rod swing and drive the first locking block and the second locking block to expand towards both ends or retract inward, wherein the locking release rack teeth extend out of the square outer cover or retract into the square outer cover.

3. The adjustable height square outer cover with the built-in cylinder according to claim 2, wherein the water tank shell comprises a shell body and a fixed support fixedly arranged on the shell body, the installation accommodation cavity is arranged in the shell body, and the shell body is provided with a shell opening; the fixed support is provided with a support through hole aligned with the shell opening after assembly, and the support rack teeth are symmetrically arranged on an inner wall of the support through hole; during locking, the locking release rack teeth reach out from the square outer cover and engage with the support rack teeth; when the lock is disengaged, the locking release rack teeth are retracted into the square outer cover, wherein the locking release rack teeth and the support rack teeth are disengaged, so as to adjust the distance of the square outer cover extending out of the installation accommodation cavity.

4. The adjustable height square outer cover with the built-in cylinder according to claim 3, wherein the square outer cover is provided with a second mounting cavity for an installation of the handle and a third mounting cavity for an installation of the locking release device, a connecting through hole for the pull rod to pass through after assembly is arranged between the third mounting cavity and the second mounting cavity, an inner wall of the third mounting cavity is provided with a transverse chute and a longitudinal chute, and the pull rod is provided with a pull rod sliding strip sliding in the transverse chute after assembly; and both the first locking block and the second locking block are provided with a locking block sliding strip sliding in the longitudinal chute after assembly.

5. The adjustable height square outer cover with the built-in cylinder according to claim 4, wherein the handle comprises a handle main body part and a handle portion integrated with the handle main body part, the pull rod is provided with a second pull rod hole, the handle main body part is provided with a handle mounting cavity, and an inner wall of the handle mounting cavity is provided with a raised handle hinge shaft matched with the second pull rod hole.

6. The adjustable height square outer cover with the built-in cylinder according to claim 5, wherein an inner wall of the second mounting cavity is respectively provided with a raised positioning column, a positioning strip and a positioning flange, and the handle main body part is provided with a positioning groove matched with the positioning flange; when the locking release device is in a locked state, an end face of one end of the handle portion towards the handle body part butts against the positioning strip, and the positioning groove is clamped in the positioning flange; when the locking release device is in the unlocked state, an end face of one end of the handle body part towards the handle portion butts against the positioning column.

7. The adjustable height square outer cover with the built-in cylinder according to claim 6, wherein the handle is also provided with an unlocking contact surface and a locking contact surface, and the unlocking contact surface is against the inner wall of the second mounting cavity when the locking release device is in the unlocked state; the locking contact surface is against the inner wall of the second mounting cavity when the locking release device is in the locked state; a distance D1 between an axis of the handle hinge shaft and the unlocking contact surface is less than a distance D2 between the axis of the handle hinge shaft and the locking contact surface, wherein when the handle locks the locking release device, the pull rod is partially pulled into the second mounting cavity by the handle, wherein the first connecting rod and the second connecting rod swing and drive the first locking block and the second locking block to expand towards both ends.

8. The adjustable height square outer cover with the built-in cylinder according to claim 1, wherein the first mounting cavity is provided with first clamping teeth, and the support comprises a support body and a support adjusting plate, wherein one end of the support adjusting plate is connected with the support body, second clamping teeth matched with the first clamping teeth are arranged on an outer end face of the support adjusting plate, and a position avoidance groove is also arranged between the support adjusting plate and the support body; when the support adjusting piece is moved, the second clamping teeth are out of engagement from the first clamping teeth, and the support is moved laterally to adjust a relative position of the support in the first mounting cavity.

9. The adjustable height square outer cover with the built-in cylinder according to claim 8, wherein a raised first clamping part is arranged on an inner wall of the first mounting cavity, and a top of the first clamping part extends to one side to form a second clamping part, a first clamping groove is formed between a first end of the second clamping part and the inner wall of the first mounting cavity, and a second end of the second clamping part is provided with the first clamping teeth; the support body is located on the end face of one end of the support adjusting plate, and is also provided with a raised first connecting part; a top of the first connecting part extends to one side to form a second connecting part inserted into the first clamping groove after assembly, a first connecting groove for inserting the second clamping part after assembly is formed between the second connecting part and the support body; the support adjusting plate is provided with a first bump on a side of the second clamping teeth, and a first holding groove containing the second clamping part is formed between the first bump and the first connecting part.

10. The adjustable height square outer cover with the built-in cylinder according to claim 9, wherein one end of the support body away from the first connecting part is provided with an extension part extending outward, and the inner wall of the first mounting cavity is provided with a raised first cushion block for supporting the extension part.

11. The adjustable height square outer cover with the built-in cylinder according to claim 10, wherein the support body is provided with an adjusting cavity, an inner wall of the adjusting cavity is provided with third clamping teeth, and the cylinder comprises a cylinder body and a connecting cover arranged on the cylinder body; the connecting cover comprises a connecting cover body and a cylinder adjusting plate with one end connected with the connecting cover body, and an outer end face of the cylinder adjusting plate is provided with fourth clamping teeth matched with the third clamping teeth; when the support adjusting plate is moved, the fourth clamping teeth are out of engagement from the third clamping teeth, and the cylinder is moved longitudinally to adjust a relative position of the cylinder in the support.

12. The adjustable height square outer cover with the built-in cylinder according to claim 11, wherein the cylinder adjusting plate comprises an adjusting plate connecting part fixedly connected with the connecting cover body and an elastic part integrally formed with the adjusting plate connecting part, an avoidance space is formed between the elastic part and the connecting cover body, and an end face on one side of the elastic part away from the connecting cover body extends outward to form a handle portion.

13. The adjustable height square outer cover with the built-in cylinder according to claim 12, wherein the connecting cover body is provided with positioning strips located on both sides of the cylinder adjusting plate, and the support body is provided with a chute matched with the positioning strips.

14. The adjustable height square outer cover with the built-in cylinder according to claim 1, wherein the cylinder is provided with a pressing button, and the square outer cover is clamped with a decorative cover for covering the first mounting cavity; and the decorative cover is provided with a button opening for exposing the pressing button.

15. The adjustable height square outer cover with the built-in cylinder according to claim 14, wherein the decorative cover is provided with a decorative cover buckle, and the square outer cover outer is provided with a clamping groove matched with the decorative cover buckle.

* * * * *